US008868316B2

(12) United States Patent
Kokubo et al.

(10) Patent No.: US 8,868,316 B2
(45) Date of Patent: Oct. 21, 2014

(54) CONTROLLER OF VALVE TIMING CONTROL APPARATUS AND VALVE TIMING CONTROL APPARATUS OF INTERNAL COMBUSTION ENGINE

(75) Inventors: Naoki Kokubo, Hiratsuka (JP); Shinichi Kawada, Isehara (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 571 days.

(21) Appl. No.: 13/270,351

(22) Filed: Oct. 11, 2011

(65) Prior Publication Data

US 2012/0174883 A1 Jul. 12, 2012

(30) Foreign Application Priority Data

Jan. 12, 2011 (JP) ..... 2011-003793

(51) Int. Cl.
*F01L 1/34* (2006.01)
*F01L 1/352* (2006.01)
*F01L 1/344* (2006.01)

(52) U.S. Cl.
CPC ..... *F01L 1/352* (2013.01); *F01L 2001/3521* (2013.01)
USPC ..... 701/103

(58) Field of Classification Search
USPC ..... 701/103, 102, 101, 115, 113; 123/90.11, 90.15, 90.18, 90.31
See application file for complete search history.

(56) References Cited

U.S. PATENT DOCUMENTS 6,637,391 B2 * 10/2003 Muraki et al. ..... 123/90.17
7,403,849 B1 * 7/2008 Watanabe et al. ..... 701/102
7,509,932 B2 * 3/2009 Hara et al. ..... 123/90.31
7,827,949 B2 * 11/2010 Suga et al. ..... 123/90.31
2012/0312259 A1 * 12/2012 Yamanaka et al. ..... 123/90.15

FOREIGN PATENT DOCUMENTS

JP 2010-138735 A 6/2010

* cited by examiner

*Primary Examiner* — Hieu T Vo
(74) *Attorney, Agent, or Firm* — Crowell & Moring LLP

(57) ABSTRACT

In a valve timing control apparatus configured to execute phase-control via a phase converter, a controller is configured to control a phase angle of a camshaft relative to a crankshaft during an engine stopping period to a target phase angle differing from a required phase angle suited for an engine operating condition. The controller is further configured to change the phase angle of the camshaft toward the required phase angle during a time period from a point of time when cranking starts to a point of time when detection of a rotational position of the camshaft initiates during an engine restarting period. The controller is still further configured to start feedback-control for the phase angle of the camshaft from the point of time of initiation of detection of the rotational position of the camshaft for bringing the phase angle of the camshaft closer to the required phase angle.

17 Claims, 9 Drawing Sheets

CONTROLLER OF VALVE TIMING CONTROL APPARATUS AND VALVE TIMING CONTROL APPARATUS OF INTERNAL COMBUSTION ENGINE

TECHNICAL FIELD

The present invention relates to a controller of a valve timing control apparatus configured to variably control valve open timing and valve closure timing of each of engine valves, such as intake and/or exhaust valves, by the use of an electric motor, and specifically to an electric-motor-driven valve timing control apparatus of an internal combustion engine.

BACKGROUND ART

In recent years, there have been proposed and developed various electric-motor-driven valve timing control devices in which rotary motion (a torque) of an electric motor is transmitted via a speed reducer to a camshaft so as to change a relative angular phase between the engine crankshaft and the camshaft with the high control responsiveness and high controllability. One such electric-motor-driven valve timing control device has been disclosed in Japanese Patent Provisional Publication No. 2010-138735 (hereinafter is referred to as "JP2010-138735"). In the valve timing control device disclosed in JP2010-138735, by virtue of electric-current supply via spring-loaded brushes and slip rings to an electric motor, the motor is rotated. The rotary motion of the electric motor is transmitted via a speed reducer to a camshaft, and as a result an angular phase of the camshaft relative to the crankshaft is changed to control engine valve timing, such as intake valve timing.

However, the valve timing control device disclosed in JP2010-138735, suffers from the drawback that, when initiating relative-phase control between the crankshaft and the camshaft during an engine starting period, in particular, when starting with a cold engine, an electric motor is driven from its stopped state and thus a time loss occurs owing to a static friction before the electric motor actually begins to rotate and hence undesirable hunting of the automatic phase control system occurs. As a result of such undesirable hunting, a control state of the phase control system tends to become unstable immediately after the electric motor has been driven. Therefore, it would be desirable to reconcile both a phase-change control responsiveness and a phase-change control stability without undesirable hunting, even during an engine starting period.

SUMMARY OF THE INVENTION

It is, therefore, in view of the previously-described disadvantages of the prior art, an object of the invention to provide a controller of a valve timing control apparatus and a valve timing control apparatus of an internal combustion engine, capable of reconciling both a control responsiveness and a control stability of an electric-motor-driven phase-change control system even during an engine starting period.

In order to accomplish the aforementioned and other objects of the present invention, a controller of a valve timing control apparatus including a drive rotary member adapted to rotate in synchronism with rotation of a crankshaft of an engine, an electric motor which rotates together with the drive rotary member and to which electric current is supplied via brushes, and a phase converter configured to change a phase angle of a camshaft relative to the crankshaft by relatively rotating an output shaft of the electric motor with respect to the drive rotary member, said controller comprises a detection section configured to detect a rotational position of the camshaft, and a control section programmed to perform the following, (a) executing phase-control via the phase converter for bringing the phase angle of the camshaft relative to the crankshaft closer to a required phase angle suited for engine-starting during a starting period of the engine;

(b) controlling the phase angle of the camshaft during a stopping period of the engine to a target phase angle differing from the required phase angle suited for engine-starting;

(c) changing the phase angle of the camshaft from the target phase angle toward the required phase angle during a time period from a point of time when cranking starts during a restarting period of the engine to a point of time when detection of the rotational position of the camshaft, executed within the detection section, initiates during the engine restarting period; and (d) starting feedback-control for the phase angle of the camshaft via the phase converter from the point of time of initiation of detection of the rotational position of the camshaft, executed within the detection section, for bringing the phase angle of the camshaft closer to the required phase angle.

According to another aspect of the invention, a controller of a valve timing control apparatus including a drive rotary member adapted to rotate in synchronism with rotation of a crankshaft of an engine, an electric motor which rotates together with the drive rotary member and to which electric current is supplied via brushes, and a phase converter configured to change a phase angle of a camshaft relative to the crankshaft by relatively rotating an output shaft of the electric motor with respect to the drive rotary member, said controller comprises a detection section configured to detect a rotational position of the camshaft, and a control section programmed to perform the following, starting phase-control, by which the phase angle of the camshaft can be brought closer to a required phase angle suited for engine-starting via the phase converter by feeding back a result of detection of the detection section, continuously from a state where the electric motor has already rotated during a starting period of the engine.

According to a further aspect of the invention, a valve timing control apparatus of an internal combustion engine comprises a drive rotary member adapted to rotate in synchronism with rotation of a crankshaft of the engine, an electric motor which rotates together with the drive rotary member and to which electric current is supplied via brushes, a phase converter configured to change a phase angle of a camshaft relative to the crankshaft by relatively rotating an output shaft of the electric motor with respect to the drive rotary member, a phase angle detector configured to detect a rotational position of the camshaft, and a controller comprising a processor programmed to perform the following, (a) executing phase-control via the phase converter for bringing the phase angle of the camshaft relative to the crankshaft closer to a required phase angle suited for engine-starting during a starting period of the engine;

(b) stopping the phase converter at a target phase angle differing from the required phase angle during a stopping period of the engine; and (c) starting feedback-control, by which the phase angle of the camshaft can be brought closer to the required phase angle by feeding back a result of detection of the phase angle detector, in a manner so as to drive the electric motor in the same direction of rotation of the electric motor continuously from a state where the electric motor has already rotated after initiation of cranking during a restarting period of the engine.

The other objects and features of this invention will become understood from the following description with reference to the accompanying drawings.

DESCRIPTION OF THE PREFERRED EMBODIMENTS

Figure 1:
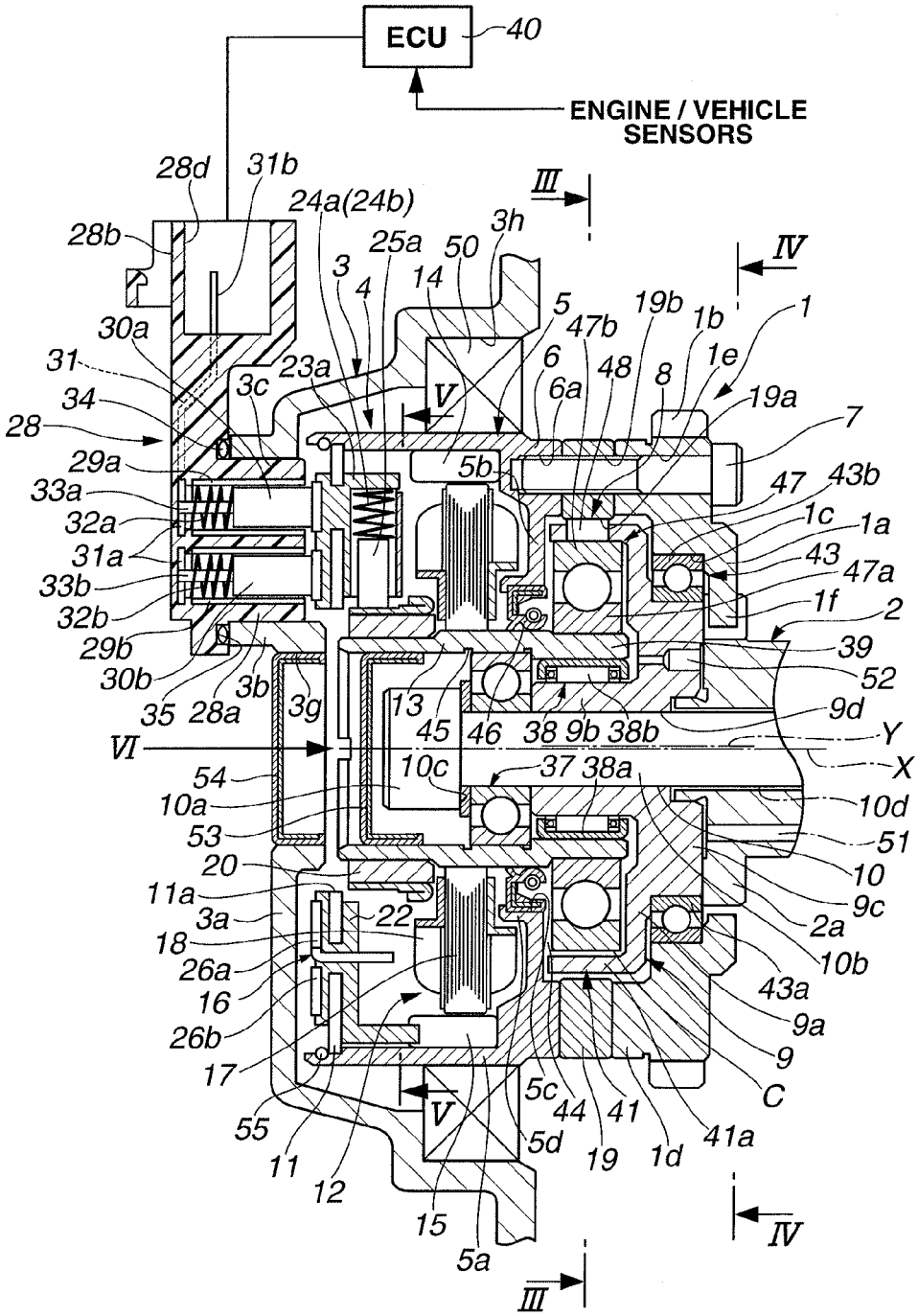
FIG. 1 is a longitudinal cross-sectional view illustrating an embodiment of a valve timing control (VTC) apparatus.

A valve timing control (VTC) apparatus of an internal combustion engine of the embodiment and its controller are hereinafter described in detail in reference to the drawings. In the shown embodiment, the VTC apparatus is applied to a valve operating system of the intake-valve side of the internal combustion engine. In lieu thereof, the VTC apparatus may be applied to a valve operating system of the exhaust-valve side of the engine As shown in FIGS. 1-3, the VTC apparatus of the embodiment is comprised of a timing sprocket 1 (a drive rotary member) that rotates in synchronism with rotation of an engine crankshaft, a camshaft 2 rotatably supported on a cylinder head (an engine body not shown) through camshaft-journal bearings (not shown) and driven by torque transmitted from timing sprocket 1, a cover member 3 (a stationary member) laid out in front of the timing sprocket 1 and bolted to a chain cover (not shown), and a phase converter 4 installed between timing sprocket 1 and camshaft 2 for changing a relative angular phase between timing sprocket 1 and camshaft 2 depending on an engine operating condition.

Timing sprocket 1 is comprised of an annular sprocket body 1*a*, and a timing gear 1*b*. Sprocket body 1*a* is made of iron-based metal material, and formed with a stepped inner peripheral portion and formed integral with timing gear 1*b*. Timing gear 1*b* receives torque from the crankshaft through a timing chain (not shown) wound on both a sprocket on the crankshaft and the sprocket 1 on the camshaft. Timing sprocket 1 is rotatably supported by a middle-diameter ball bearing 43 interleaved between a circular groove 1*c* formed in sprocket body 1*a* and the outer periphery of a thick-wall flanged portion 2*a* integrally formed with the front end of camshaft 2.

Sprocket body 1*a* has an axially-protruding annular edged portion 1*d* formed integral with the outer periphery of its front end. As shown in FIGS. 1-2, an annular member (an end face meshing member) 19 is located on the front end face of sprocket body 1*a* and positioned coaxially with the axis (the geometric center) of the annular front end face of axially-protruding annular edged portion 1*d*. Annular member 19 is formed on its inner periphery with a plurality of waveform internal teeth 19*a* (see FIGS. 1 and 3). A female-screw-threaded annular portion 6 is located on the front end of annular member 19 and formed integral with a substantially cylindrical-hollow housing 5 in which an electric motor 12 (described later) is enclosed.

Figure 2:
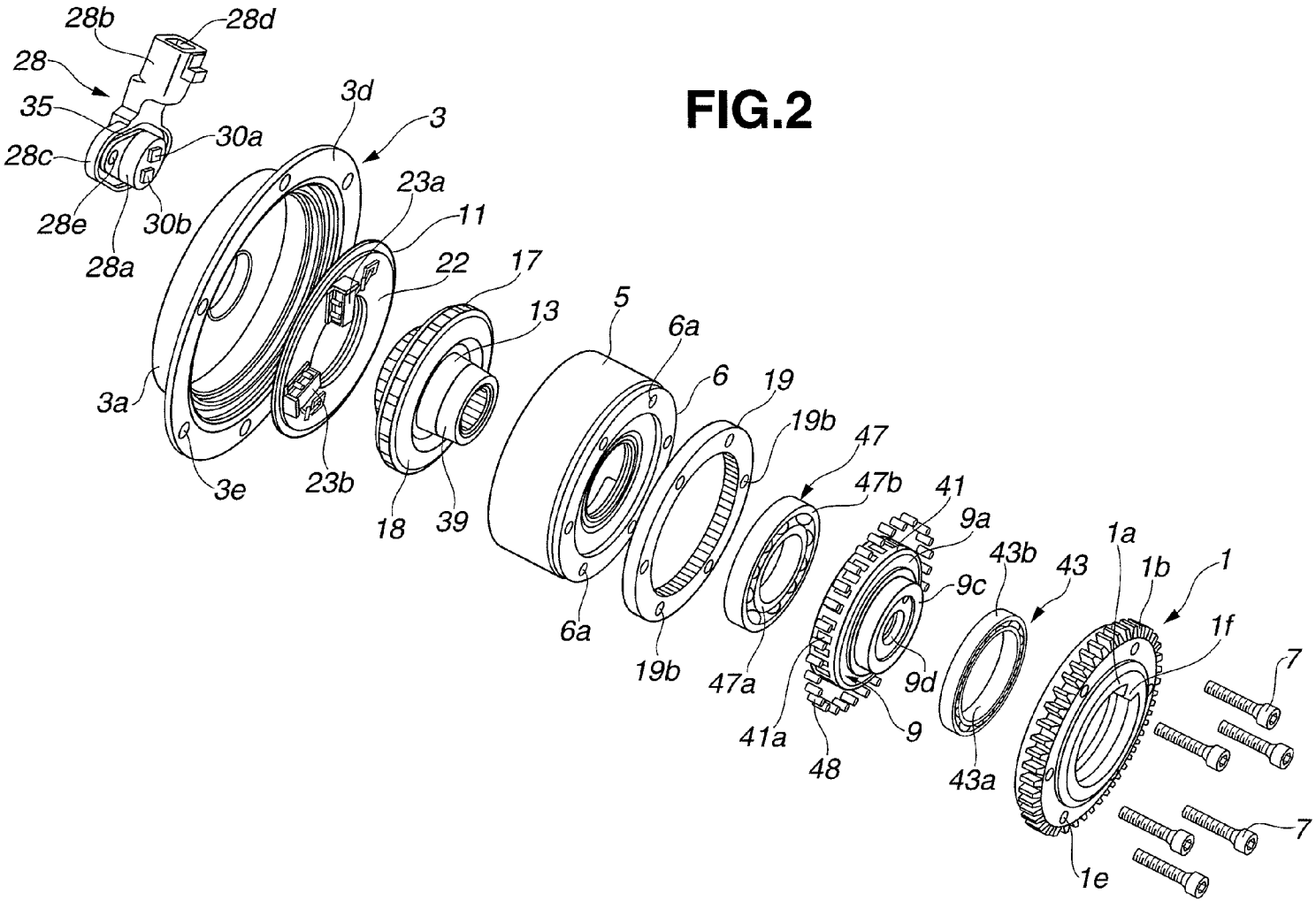
FIG. 2 is a perspective disassembled view illustrating essential component parts of the VTC apparatus of the embodiment.
Figure 3:
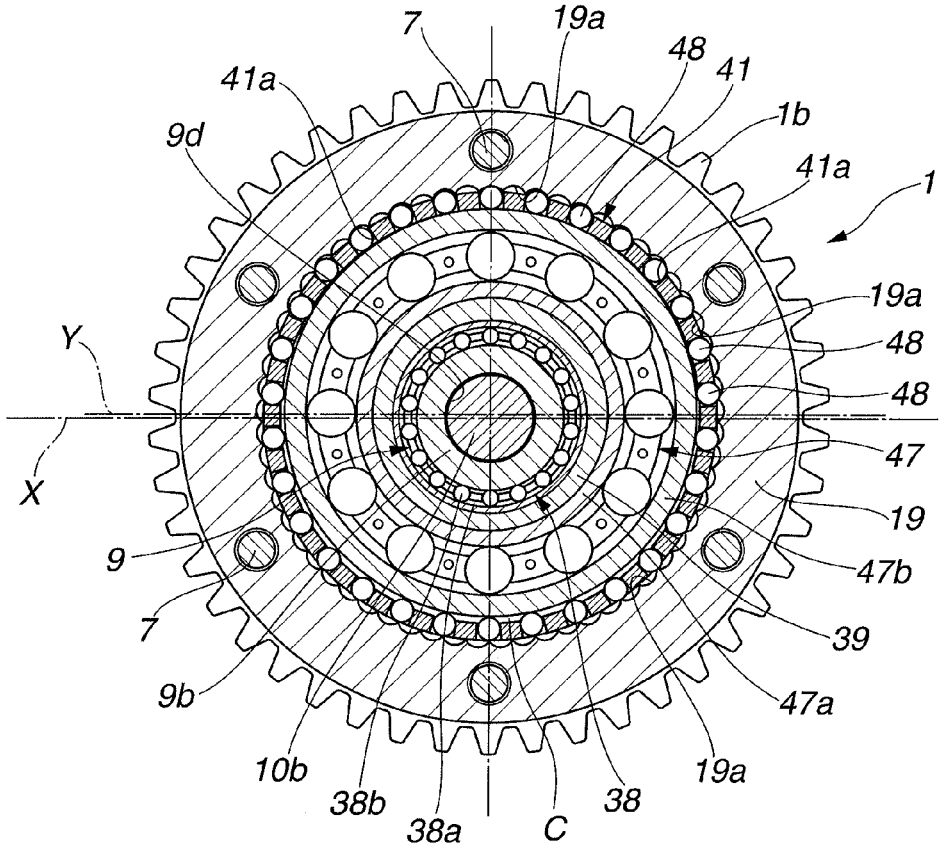
FIG. 3 is a lateral cross section taken along the line of FIG. 1.

As clearly shown in FIG. 2, sprocket body 1*a* has circumferentially-equidistant-spaced six bolt insertion holes le formed as through holes. Also, annular member 19 has circumferentially-equidistant-spaced six bolt insertion holes 19*b* formed as through holes. Female-screw-threaded annular portion 6 has six female-screw threaded holes 6*a* configured to be conformable to shapes of the respective bolt insertion holes (1*e*, 19*b*) of sprocket body 1*a* and annular member 19. Female-screw-threaded annular portion 6 is fixedly connected to the front end face (the left-hand side face, viewing FIG. 1) of annular member 19, such that the outer periphery of sprocket body 1*a* of sprocket 1, annular member 19, and the female-screw-threaded annular portion 6 (housing 5), are integrally connected to each other by axially fastening them together with bolts 7.

Sprocket body 1*a* and annular member 19 construct a casing of a speed reducer 8 (described later).

The outside diameters of axially-protruding annular edged portion 1*d* of sprocket body 1*a*, annular member 19, and female-screw-threaded annular portion 6 are dimensioned to be substantially identical to each other.

Figure 4:
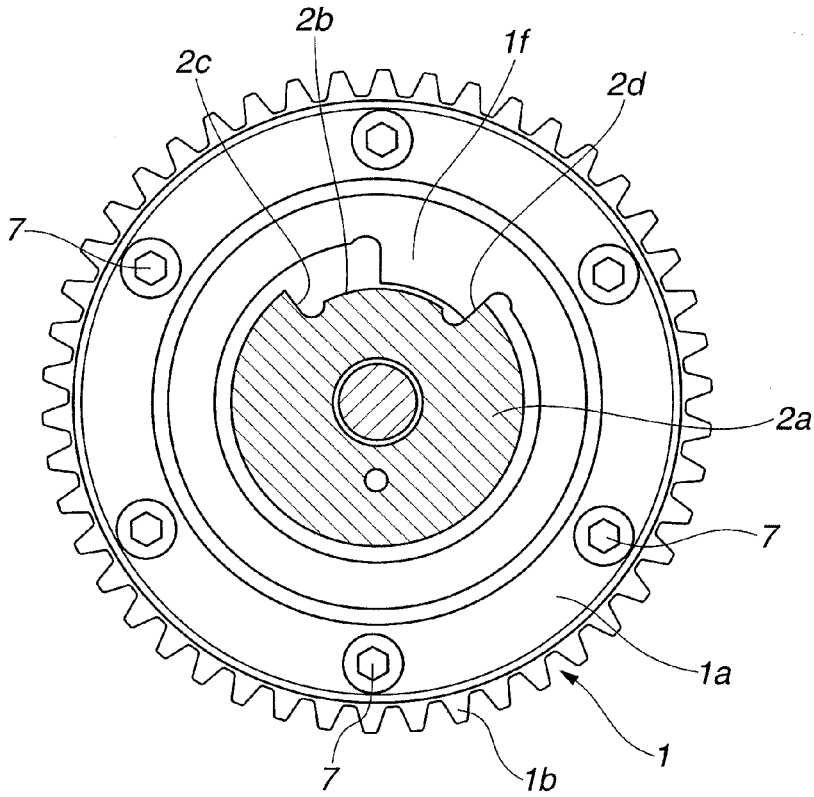
FIG. 4 is a lateral cross section taken along the line IV-IV of FIG. 1.

Additionally, as best seen in FIG. 4, the inner peripheral portion of sprocket body 1*a* is partially formed integral with a circular-arc shaped radially-inward-protruding stopper portion if circumferentially extending over a given circumferential length.

Cover member 3 is formed as a substantially cup-shaped integral cover, which is made of aluminum alloy. Cover member 3 is comprised of a substantially cup-shaped cover main portion 3*a* and an axially-extending cylindrical wall portion 3*b* partly formed integral with the outer peripheral portion of cover main portion 3*a*. Cover main body 3*a* is laid out to cover almost the entire circumference of the front end of housing 5, ranging from the leftmost end (viewing FIG. 1) via the cylindrical-hollow housing portion to the rear end, with a given aperture. Cylindrical wall portion 3*b* is formed on its inner periphery with a brush-retainer bore 3*c* (see FIG. 1). The inner peripheral surface of brush-retainer bore 3*c* is formed as a guide surface for a brush retainer 28 (described later).

As shown in FIG. 2, the outer periphery of cover member 3 is formed as a flanged portion 3*d*. The flanged portion 3*d* has circumferentially-equidistant-spaced six bolt insertion holes 3*e* formed as through holes. Cover member 3 is fixedly connected to the chain cover (not shown) by tightening six bolts (not shown) inserted into the respective bolt insertion holes 3*e*.

As shown in FIG. 1, an oil seal 50 (a relatively large-diameter seal ring) is interleaved between the outer peripheral surface of housing 5 and the inner peripheral surface of cover main portion 3*a* and located between the stepped portion and the flanged portion 3*d* of cover main portion 3*a*. Oil seal 50 is a typical spring-loaded, synthetic-rubber-covered seal ring consisting of a single lip using a spring, a metal case and a dust lip using no spring. The outer periphery of the annular rubber portion of oil seal 50 is fitted into a stepped annular portion 3*h* formed in the inner periphery of the rear end of cover member 3. The inner peripheral surface of the annular rubber portion of oil seal 50 functions as a seal surface, which is kept in sliding-contact with the outer peripheral surface of the cylindrical portion of housing 5.

Housing 5 is made of iron-based metal material, and comprised of a cylindrical housing main body 5*a* and a disk-shaped housing bottom portion 5*b* integrally formed at the rear end of housing 5 with the housing main body 5*a* by press molding, and a substantially annular seal plate 11 provided to seal the front-end opening of housing main body 5*a*. Housing bottom portion 5*b* is formed at its center with a large-diameter shaft insertion hole 5*c* into which a substantially cylindrical-hollow eccentric shaft portion 39 (described later) is inserted. Housing bottom portion 5*b* is also formed with a cylindrical portion 5*d* slightly axially extending leftwards from the front end of shaft insertion hole 5*c*. The previously-discussed female-screw-threaded annular portion 6 is integrally formed with the circumference of housing bottom portion 5*b*.

Camshaft 2 has two drive cams (per cylinder) integrally formed on its outer periphery for operating the associated two intake valves (not shown) per one engine cylinder. A driven member (a driven rotary member) 9 is fixedly connected to the front end of camshaft 2 by means of a cam bolt 10. As shown in FIG. 4, the flanged portion 2*a* of camshaft 2 has a circumferentially-extending stopper recessed groove 2*b*, which is formed along the circumferential direction and into which the radially-inward-protruding stopper portion 1*f* of sprocket body 1*a* is engaged. The stopper recessed groove 2*b* is formed into a circular-arc shape having a given circumferential length greater than the given circumferential length of the radially-inward-protruding stopper portion 1*f*, in such a manner as to permit rotary motion of camshaft 2 within a limited range. Actually, as can be seen from the lateral cross-section of FIG. 4, the clockwise rotary motion of camshaft 2 relative to timing sprocket 1 is restricted by abutment between an anticlockwise end face of radially-inward-protruding stopper portion if and a clockwise-opposing end face 2*c* of stopper recessed groove 2*b*. On the other hand, the anticlockwise rotary motion of camshaft 2 relative to timing sprocket 1 is restricted by abutment between a clockwise end face of radially-inward-protruding stopper portion 1*f* and an anticlockwise-opposing end face 2*d* of stopper recessed groove 2*b*. More concretely, the maximum phase-retard side angular position of camshaft 2 relative to timing sprocket 1 is restricted by abutment between the clockwise end face of radially-inward-protruding stopper portion if and the anticlockwise-opposing end face 2*d* of stopper recessed groove 2*b*, whereas the maximum phase-advance side angular position of camshaft 2 relative to timing sprocket 1 is restricted by abutment between the anticlockwise end face of radially-inward-protruding stopper portion if and the clockwise-opposing end face 2*c* of stopper recessed groove 2*b*. The previously-discussed radially-inward-protruding stopper portion if and stopper recessed groove 2*b* cooperate with each other to construct a stopper mechanism.

As best seen in FIG. 1, cam bolt 10 is comprised of a head 10*a* and a shank 10*b* formed integral with the head 10*a*. An annular washer 10*c* is located on the end face of head 10*a*, facing the shank 10*b*. The shank 10*b* is formed on its outer periphery with a male-screw-threaded portion 10*d*, which is screwed into a female-screw-threaded portion machined in the front end of camshaft 2 along the axis of camshaft 2.

Driven member 9 is made of iron-based metal material. As seen from the longitudinal cross section of FIG. 1, the driven member 9 is comprised of a rear-end disk-shaped portion 9*a* and an axially-forward-extending cylindrical-hollow portion 9*b* formed integral with the front end face of disk-shaped portion 9*a*.

The disk-shaped portion 9*a* is integrally formed on the central portion of its rear end face with an annular stepped portion 9*c*. The outer periphery of annular stepped portion 9*c* and the outer periphery of flanged portion 2*a* are assembled to be opposed to each other, and additionally the annular stepped portion 9*c* of driven member 9 and the flanged portion 2*a* of camshaft 2 are fitted to the inner periphery of the inner race 43*a* of the middle-diameter ball bearing 43. Hereby, when assembling, the axis of camshaft 2 and the axis of driven member 9 can be easily precisely aligned with each other. On the other hand, the outer race 43*b* of the middle-diameter ball bearing 43 is press-fitted to the inner periphery of circular groove 1*c* of sprocket body 1*a*.

As shown in FIGS. 1-3, the outer periphery of disk-shaped portion 9*a* of driven member 9 is formed integral with a cage 41, which serves as a roller holder for holding a plurality of rollers 48 (rolling elements). Cage 41 is shaped into a substantially cylindrical shape configured to extend from the outer periphery of disk-shaped portion 9*a* of driven member 9 in the same axial direction as cylindrical-hollow portion 9*b*. Cage 41 has a plurality of substantially rectangular roller retaining holes 41*a* formed in a manner so as to be circumferentially equidistant-spaced with each other, for rotatably retaining rollers 48 inside of the respective roller retaining holes 41*a*. Also, the axially-extending cylindrical edge of cage 41 is configured to extend toward the housing bottom portion 5*b* through an annular space 44 defined between the previously-discussed female-screw-threaded annular portion 6 and the axially-extending cylindrical portion 5*d*.

As shown in FIGS. 1 and 3, cylindrical-hollow portion 9*b* is formed with a central bore 9*d* into which the shank 10*b* of cam bolt 10 is inserted. A needle bearing 38 is mounted on the outer periphery of cylindrical-hollow portion 9*b*.

The previously-discussed phase converter 4 is constructed by the electric motor 12, serving as an actuator and located at the front end of camshaft 2 and arranged coaxial with the axis of camshaft 2, and the speed reducer 8. Speed reducer 8 is provided to reduce the rotational speed of the output shaft 13 of electric motor 12 and to transmit the reduced rotational speed (in other words, the increased torque) to camshaft 2.

As shown in FIGS. 1-2, in particular, as best seen from the cross section of FIG. 1, electric motor 12 is a brush-equipped direct-current (DC) motor. Electric motor 12 is comprised of the housing 5 serving as a yoke and rotating together with timing sprocket 1, the motor output shaft 13 rotatably provided in housing 5, a pair of substantially semi-circular permanent magnets 14-15 fixedly connected onto the inner peripheral surface of the cylindrical portion of housing 5, and the stator 16 mounted on the seal plate 11.

Motor output shaft 13 is formed into a substantially cylindrical-hollow shape, and serves as an armature. An iron-core rotor 17, having a plurality of magnetic poles, is fixedly connected onto the outer periphery of motor output shaft 13 substantially at a midpoint of the axially-extending cylindrical-hollow motor output shaft 13. An electromagnetic coil 18 is wound on the outer periphery of the iron-core rotor 17. A commutator 20 is press-fitted onto the outer periphery of the small-diameter portion of the front end of the cylindrical-hollow motor output shaft 13. Commutator 20 is divided into a plurality of segments whose number is equal to the number of magnetic poles of iron-core rotor 17. Electromagnetic coil 18 is electrically connected to each of the segments of commutator 20.

Figure 5:
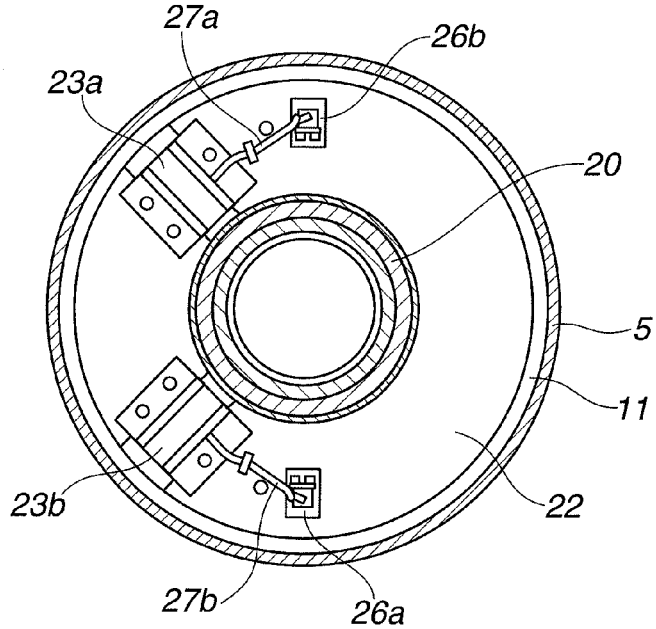
FIG. 5 is a lateral cross section taken along the line V-V of FIG. 1.
Figure 6:
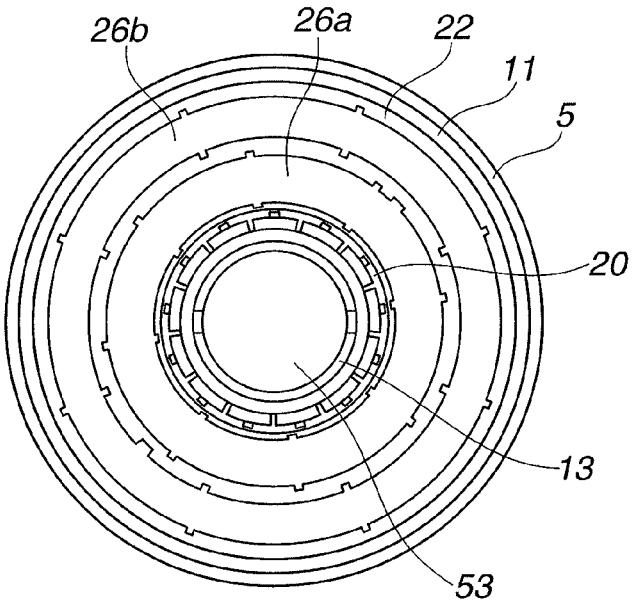
FIG. 6 is a view taken in the direction of the arrow VI in FIG. 1

As shown in FIG. 5, stator 16 is comprised of a disk-shaped synthetic-resin plate 22, a pair of synthetic-resin holders 23*a*-23*b*, a pair of first brushes 25*a*-25*b*, a pair of annular slip rings 26*a*-26*b* concentrically arranged with each other (see FIG. 6), and a pair of pig-tale harnesses 27*a*-27*b*. The synthetic-resin plate 22 is integrally connected to the inside wall surface of seal plate 11. The brush holders 23*a*-23*b* are located on the inside of synthetic-resin plate 22. The first brushes 25*a*-25*b* are accommodated in the respective synthetic-resin holders 23*a*-23*b* in such a manner as to be radially slidable. The tips of the first brushes 25*a*-25*b* are permanently forced radially toward the outer peripheral surface of commutator 20 by the spring forces of coil springs 24*a*-24*b*. As can be seen from the cross section of FIG. 1, annular slip rings 26*a*-26*b* are partly buried and fixed onto the front end face of synthetic-resin holders 23*a*-23*b* (i.e., the front end face of synthetic-resin plate 22), under a condition where the outside end faces of slip rings 26*a*-26*b* are exposed forward. As clearly shown in FIG. 5, the first brush 25*a* and the slip ring 26*b* are electrically connected to each other via the pig-tale harness 27*a*. In a similar manner, the first brush 25*b* and the slip ring 26*a* are electrically connected to each other via the pig-tale harness 27*b*.

Seal plate 11 is positioned and fitted to the stepped recessed groove formed in the inner periphery of the front end of the cylindrical housing main body 5*a* by means of a snap ring 55. Seal plate 11 has a central bore (a central opening) through which one end of motor output shaft 13 is inserted.

Brush retainer 28, integrally molded and produced by synthetic resin, is attached to the cover main portion 3*a*.

Figure 7:
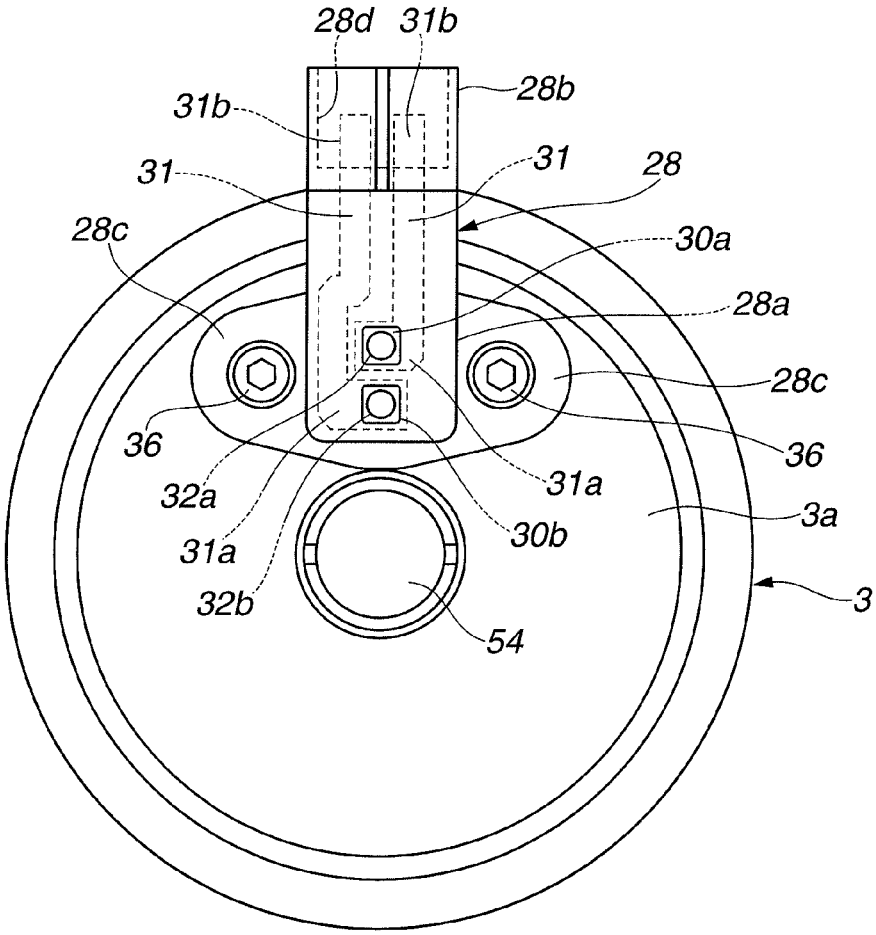
FIG. 7 is a side view illustrating the VTC apparatus of the embodiment.

As shown in FIGS. 1-2, and 7, brush retainer 28 is shaped into a substantially L shape (as seen from the side view). Brush retainer 28 is comprised of a substantially cylindrical brush retaining portion 28*a*, a connector portion 28*b*, a pair of bracket portions 28*c*, 28*c*, and a pair of terminal strips 31, 31. Brush retaining portion 28*a* is fitted into the previously-discussed brush-retainer bore 3*c* of cover member 3. Connector portion 28*b* is integrally formed with the upside of brush retaining portion 28*a*. Bracket portions 28*c*, 28*c* are integrally formed on both sides of brush retaining portion 28*a*. Brush retainer 28 is fixedly connected to the cover main portion 3*a* of cover member 3 by fastening the bracket portions 28*c*, 28*c* with bolts 36, 36 (described later). The major part of each of terminal strips 31, 31 is buried in the synthetic-resin brush retainer 28.

These two terminal strips 31, 31 are arranged parallel to each other in such a manner as to vertically extend and partly cranked. One end (the lower terminal) 31*a* of each terminal strip 31 is laid out to be exposed onto the bottom face of brush retaining portion 28*a*, whereas the other end (the upper terminal) 31*b* of each terminal strip 31 is laid out to protrude into a female fitted groove 28*d* of connector portion 28*b*. Each upper terminal 31*b* is electrically connected via a male terminal (not shown) to a car battery (an electric-power source).

Brush retaining portion 28*a* has an upper sleeve 29*a*, fitted into a cylindrical through hole formed in brush retaining portion 28*a* and extending in the axial direction of the camshaft, and a lower sleeve 29*b*, fitted into a cylindrical through hole formed in brush retaining portion 28*a* and extending in the axial direction of the camshaft. A pair of second brushes 30*a*-30*b* are axially slidably fitted into the respective sleeves 29*a*-29*b*. To ensure electric-contact (sliding-contact), the second brushes 30*a*-30*b* are axially permanently spring-loaded toward the outer periphery of the respective slip rings 26*a*-26*b*.

Each of second brushes 30*a*-30*b* is shaped into a substantially rectangular parallelepiped shape. A second coil spring 32*a* is interleaved between the lower terminal 31*a* located on the bottom face of the upper cylindrical through hole formed in brush retaining portion 28*a* and the second brush 30*a*, so as to force the second brush 30*a* into electric-contact with the slip ring 26*b*. In a similar manner, a second coil spring 32*b* is interleaved between the lower terminal 31*a* located on the bottom face of the lower cylindrical through hole formed in brush retaining portion 28*a* and the second brush 30*b*, so as to force the second brush 30*b* into electric-contact with the slip ring 26*a*. Also, the inside axial end (the left-hand axial end, viewing FIG. 1) of the second brush 30*a* and the lower terminal 31*a* located on the bottom face of the upper cylindrical through hole formed in brush retaining portion 28*a* are electrically connected to each other via a flexible pig-tale harness 33*a* welded to them. In a similar manner, the inside axial end of the second brush 30*b* and the lower terminal 31*a* located on the bottom face of the lower cylindrical through hole formed in brush retaining portion 28*a* are electrically connected to each other via a flexible pig-tale harness 33*b* welded to them. The entire length of each of pig-tale harnesses 33*a*-33*b* is dimensioned in a manner so as to avoid the second brushes 30*a*-30*b* from being fallen from the respective sleeves 29*a*-29*b* with a maximum extended stroke of each of the second brushes 30*a*-30*b* outside of the respective sleeves 29*a*-29*b*.

An annular seal member 34 is fitted into a substantially annular groove 35 (see FIGS. 1-2) formed in the outer periphery of the root of brush retaining portion 28*a*. Hence, when assembling and fitting the brush retaining portion 28*a* into the brush-retainer bore 3*c* of cover member 3, seal member 34 is elastically deformed and brought into elastic-contact with the annular front end face of cylindrical wall portion 3*b*, thereby providing a good seal for the inside of brush retaining portion 28*a*.

For the purpose of both good elastic contact between the second brushes 30*a*-30*b* with the respective slip rings 26*a*-26*b* and avoidance of falling of the second brushes 30*a*-30*b* from the respective sleeves 26*a*-26*b*, a length L between (i) the outside axial end face (the right-hand axial end, viewing FIG. 1) of each of the second brushes 30*a*-30*b* and (ii) the opening end face of brush retaining portion 28*a*, measured under a maximum extended stroke of each of the spring-loaded second brushes 30*a*-30*b* outside of the respective sleeves 26*a*-26*b* under a condition where brush retainer 28 is removed from the brush-retainer bore 3*c*, is dimensioned to be shorter than a length L1 between (i) the outside axial end face (the right-hand axial end, viewing FIG. 1) of each of the second brushes 30*a*-30*b* and (ii) the annular front end face of cylindrical wall portion 3*b*, measured in an elastic-contact state of each of the spring-loaded second brushes 30*a*-30*b* with the respective sleeves 26*a*-26*b* under a condition where the brush retaining portion 28*a* of brush retainer 28 is fitted into the brush-retainer bore 3*c*.

The upper terminals 31*b* of connector portion 28*b* are electrically connected via the male terminal (not shown), fitted to the female fitted groove 28*d*, to a control unit 40, serving as an electronic control unit (ECU).

Referring now to FIG. 7, each of bracket portions 28*c*, 28*c* is shaped into a substantially triangle. Each of bracket portions 28*c*, 28*c* has a bolt insertion hole 28*e* formed as a through hole. Bolts 36, 36 are inserted through the respective bolt insertion holes 28*e*, 28*e* and then screwed into respective female-screw-threaded portions formed in the cover main portion 3*a* of cover member 3, such that brush retainer 28 is fixedly connected to the cover main portion 3*a* of cover member 3 by fastening the bracket portions 28*c*, 28*c* with bolts 36, 36.

Returning to FIG. 1, motor output shaft 13 is rotatably supported on the cam bolt 10 by means of a small-diameter ball bearing 37 and the needle bearing 38. In more detail, needle bearing 38 is installed on the outer periphery of cylindrical-hollow portion 9*b* of driven member 9. On the other hand, the small-diameter ball bearing 37 is installed on the outer periphery of the cam-bolt shank 10*b* in close proximity to the cam-bolt head 10*a*. As can be seen from the cross sections of FIGS. 1 and 3, the cylindrical-hollow motor output shaft 13 is also formed at the rear end (facing the front end of camshaft 2) integral with a substantially cylindrical-hollow eccentric shaft portion 39. The eccentric shaft portion 39 constructs a part of an eccentric rotation member, which is one component part of speed reducer 8.

As shown in FIG. 3, needle bearing 38 is comprised of a cylindrical retainer 38*a* press-fitted into the inner peripheral surface of eccentric shaft portion 39 and a plurality of needle rollers 38*b* rotatably retained inside of the retainer 38*a*. Each of needle rollers 38*b* is in rolling-contact with the outer peripheral surface of the cylindrical-hollow portion 9*b* of driven member 9. As seen from the cross section of FIG. 1, the inner race of the small-diameter ball bearing 37 is fixed and sandwiched between the cam-bolt washer 10*c* and the front end face of cylindrical-hollow portion 9*b*. On the other hand, the outer race of the small-diameter ball bearing 37 is positioned and sandwiched between the stepped portion formed on the inner periphery of the cylindrical-hollow motor output shaft 13 and a snap ring 45 (a C-type retaining ring fitted into an annular groove formed in the inner periphery of motor output shaft 13).

A small-diameter oil seal 46 (a relatively small-diameter seal ring) is interleaved between the outer peripheral surface of motor output shaft 13 (in close proximity to the eccentric shaft portion 39) and the inner peripheral surface of the axially-extending cylindrical portion 5*d* of housing 5, for preventing leakage of lubricating oil from the inside of speed reducer 8 toward the electric motor 12. The oil seal 46 is a typical spring-loaded, synthetic-rubber-covered seal ring consisting of a single lip using a spring, a metal case and a dust lip using no spring. The inner peripheral portion of the oil seal 46 is kept in elastic-contact and in sliding-contact with the outer peripheral surface of the cylindrical-hollow motor output shaft 13, so as to apply a frictional resistance to rotation of motor output shaft 13.

As shown in FIG. 1, control unit 40 generally comprises a microcomputer. Control unit 40 includes an input/output interface (I/O), memories (RAM, ROM), and a microprocessor or a central processing unit (CPU). The input/output interface (I/O) of control unit 40 receives input information from various engine/vehicle sensors, namely a crank angle sensor (a crankshaft position sensor), an airflow meter, an engine temperature sensor (e.g., an engine coolant temperature sensor), an accelerator opening sensor (an accelerator angular position sensor), and the like. Within control unit 40, the central processing unit (CPU) allows the access by the I/O interface of input informational data signals from the previously-discussed engine/vehicle sensors. The CPU of control unit 40 is responsible for carrying the engine control program stored in memories and is capable of performing necessary arithmetic and logic operations, depending on the current engine/vehicle operating condition, determined based on signals from the engine/vehicle sensors. Computational results (arithmetic calculation results), that is, calculated output signals are relayed through the output interface circuitry of the control unit to output stages (actuators), for engine control, including control of the VTC system.

Also, control unit 40 is also configured to set or compute a required phase angle of camshaft 2 relative to timing sprocket 1 (i.e., the engine crankshaft), based on the current engine operating condition (e.g., engine speed and engine load) and a feedback signal from phase-angle detection means provided for detecting the current rotational position of camshaft 2. Control unit 40 is further configured to perform, based on the computed required phase angle, normal-rotation/reverse-rotation control of motor output shaft 13 by controlling electric-current supply to electromagnetic coil 18 of electric motor 12, while reducing the rotational speed of motor output shaft 13 by means of speed reducer 8. In this manner, the actual relative angular phase of camshaft 2 to timing sprocket 1 can be controlled based on the computed required phase angle.

The previously-noted phase-angle detection means is comprised of an angular position sensor (e.g., a camshaft position sensor or a motor-output-shaft position sensor) for detecting a rotational position of camshaft 2 in the form of a pulse signal, and an arithmetic circuit (a phase-angle detector or a detection section) included in control unit 40 for arithmetically calculating, based on the pulse signal from the angular position sensor, the current rotational position of camshaft 2. With the previously-discussed arrangement of the phase-angle detection means, it is possible to enhance the accuracy of detection of the rotational position of camshaft 2.

As described later, control unit 40 is also configured to perform rotation control of electric motor 12 responsively to an engine temperature (e.g., an engine coolant temperature Tw) during a time period from a point of time when the engine is stopped to a point of time when the engine is started/restarted. By this, during the engine stopped period, the phase angle of camshaft 2 relative to timing sprocket 1 (i.e., the crankshaft) can be controlled or phase-changed to a phase angle differing from the computed required phase angle in advance. In contrast, during an engine starting period having the difficulty of detecting the phase angle of camshaft 2 relative to timing sprocket 1, in other words, in an undetected state of the phase angle of camshaft 2 relative to timing sprocket 1 during the early stages of engine starting, a given operating force is applied via phase converter 4 to camshaft 2 or there is no application of operating force via phase converter 4 to camshaft 2, and thereafter feedback (F/B) control for the phase angle of camshaft 2 restarts from a point of time when phase-angle detection of camshaft 2 relative to timing sprocket 1 (that is, detection of the rotational position of camshaft 2), executable within control unit 40, initiates or restarts.

As seen from the cross sections of FIGS. 1 and 3, speed reducer 8 is mainly comprised of the eccentric shaft portion 39 (constructing a part of the eccentric rotation member) that performs eccentric rotary motion, a large-diameter ball bearing 47 (constructing the remainder of the eccentric rotation member) installed on the outer periphery of eccentric shaft portion 39, a plurality of rollers (serving as rolling elements) 48 rotatably installed on the outer periphery of the large-diameter ball bearing 47 and circumferentially arranged substantially at regular intervals, the cage 41 configured to retain the rollers 48 in their rolling directions, while permitting a radial displacement of each of rollers 48, the driven member 9 formed integral with the cage 41, and the annular member 19 with the waveform internal toothed portion 19*a* and the needle bearing 38 installed between the outer periphery of cylindrical-hollow portion 9*b* of driven member 9 and the inner periphery of eccentric shaft portion 39.

Eccentric shaft portion 39 is a substantially cylindrical cam whose geometric center "Y" (see FIGS. 1 and 3) is slightly displaced from the axis "X" (i.e., a rotation center "X" shown in FIGS. 1 and 3) of motor output shaft 13 in the radial direction. Large-diameter ball bearing 47, rollers 48 and annular member 19 construct a planetary gear drive.

Large-diameter ball bearing 47 is formed as a relatively large-diameter ball bearing, as compared to the middle-diameter ball bearing 43 and the small-diameter ball bearing 37. As viewed from the longitudinal cross section of FIG. 1 (that is, as viewed in the radial direction), the large-diameter ball bearing 47 is laid out to overlap with the needle bearing 38 over almost the entire inner peripheral face of the inner race 47*a* of the large-diameter ball bearing 47. A plurality of balls are rotatably disposed and confined between the inner and outer races 47*a*-47*b*. The inner race 47*a* is press-fitted onto the outer peripheral surface of eccentric shaft portion 39. Additionally, rollers 48, interleaved between the outer periphery of the outer race 47*b* of the large-diameter ball bearing 47 (constructing part of the eccentric rotation member) and the waveform internal toothed portion 19*a* of annular member 19, are held in rolling-contact with the outer peripheral surface of the outer race 47*b*. A crescent-shaped annular clearance C is defined between the outer peripheral surface of the outer race 47*b* and the inner peripheral surface of cage 41. Owing to eccentric rotary motion of eccentric shaft portion 39, the large-diameter ball bearing 47 is radially moved by virtue of the crescent-shaped annular clearance C. That is, the crescent-shaped annular clearance C permits a slight radial displacement (a slight oscillating motion) of the large-diameter ball bearing 47. As appreciated, the large-diameter ball bearing 47 and the eccentric shaft portion 39 construct the eccentric rotation member.

Owing to the eccentric displacement (oscillating motion) of large-diameter ball bearing 47, the radially-inward contact surface of each of rollers 48, included within a given area, is brought into abutment (rolling-contact) with the outer peripheral surface of the outer race 47*b* of large-diameter ball bearing 47. On the other hand, the radially-outward contact surfaces of some of rollers 48, associated with the given area, are fitted into some troughs of internal teeth 19*a* of annular member 19. More concretely, in the eccentric position of the eccentric rotation member (namely, large-diameter ball bearing 47 and eccentric shaft portion 39) shown in FIG. 3, roller 48, located at the 12 o'clock position, is brought into completely fitted-engagement (or deeply meshed-engagement) with the inner face of the trough between the uppermost two adjacent internal teeth 19*a*, 19*a*. In contrast, roller 48, located at the 6 o'clock position, is brought out of engagement. That is to say, owing to the eccentric displacement (oscillating motion) of the eccentric rotation member (i.e., large-diameter ball bearing 47 and eccentric shaft portion 39), rollers 48 can radially oscillate, while being circumferentially guided by two opposing inside edges of each of roller retaining holes 41*a* of cage 41.

To ensure smooth operation of the motor-driven phase-converter equipped VTC apparatus, lubricating oil is supplied into the interior space of speed reducer 8 by lubricating-oil supply/exhaust means. The lubricating-oil supply/exhaust means is comprised of an oil supply passage (not shown) formed in the camshaft-journal bearing of the cylinder head for lubricating-oil supply from a main oil gallery (not shown), an axial oil supply hole 51 (see FIG. 1) formed in the front end of camshaft 2 and communicating with the above-mentioned oil supply passage via an annular groove (not shown), a small-diameter axial oil supply hole 52 formed in the driven member 9, and large-diameter oil exhaust holes (not shown) formed in the driven member 9. Small-diameter axial oil supply hole 52 is formed as a through hole in the driven member 9 such that one end of axial oil supply hole 52 is opened into an oil groove formed in the front end face of camshaft 2 and the other end of axial oil supply hole 52 is opened into the internal space defined near both the needle bearing 38 and the large-diameter ball bearing 47. Large-diameter oil exhaust holes (not shown) are formed in the driven member 9 as oil outlets.

By the lubricating-oil supply/exhaust means, lubricating oil is fed from the discharge port of an oil pump (now shown) via the main oil gallery (not shown) formed in the cylinder head into the annular space 44 and stays in the annular space 44. Thus, by the previously-discussed lubricating-oil supply/exhaust means, sufficient lubricating oil can be constantly fed to the needle bearing 38, large-diameter ball bearing 47, internal teeth 19*a* of annular member (inner peripheral meshing member) 19, rollers 48, and the roller retaining holes 41*a* of cage 41. By the way, small-diameter oil seal 46 functions to prevent a leakage of lubricating oil staying in the annular space 44 toward the housing 5 (in particular, toward the electric motor 12).

As shown in FIG. 1, a first plug 53, having a substantially C-shape in cross section, is fitted into the inner peripheral wall of the cylindrical-hollow motor output shaft 13 for closing the inside, after cam bolt 10 has been fastened, thus preventing oil leakage (oil exhaust) from the inside of motor output shaft 13. Also, a second plug 54, having a substantially C-shape in cross section, is fitted to a central access hole 3*g* formed in a substantially center of the frontal flat wall portion of cover main body 3*a* for closing the inside.

The fundamental operation of the VTC apparatus of the embodiment is hereunder described in detail.

When the engine crankshaft rotates, timing sprocket 1 rotates in synchronism with rotation of the crankshaft through the timing chain 42. On the one hand, torque flows from the timing sprocket 1 through the annular member 19 via the female-screw-threaded annular portion 6 to the housing 5 of electric motor 12, and thus permanent magnets 14-15 and stator 16, all attached to the inner periphery of housing 5, rotate together with the housing 5. On the other hand, torque flows from the timing sprocket 1 through the annular member 19 via the rollers 48, cage 41, and driven member 9 to the camshaft 2. In this manner, the intake-valve cams of camshaft 2 are rotated for operating (opening/closing) the intake valves against the spring forces of valve springs.

During a predetermined engine operating condition after the engine start-up, an electric current is applied from control unit 40 through the terminal strips 31, 31, the pig-tale harnesses 33*a*-33*b*, the second brushes 30*a*-30*b*, and the slip rings 48*a*-48*b* to the electromagnetic coil 18 so as to perform normal-rotation/reverse-rotation control of motor output shaft 13. As a result, torque, produced by electric motor 12, is transmitted through the speed reducer (including the eccentric shaft portion 39, large-diameter ball bearing 47, rollers 48, cage 41, driven member 9, annular member 19, and needle bearing 38) to the camshaft 2, and thus an angular phase of camshaft 2 relative to timing sprocket 1 is controlled and changed.

That is, when eccentric shaft portion 39 rotates eccentrically during rotation of motor output shaft 13, each of rollers 48 moves and relocates from one of two adjacent internal teeth 19*a*, 19*a* to the other with one-tooth displacement per one complete revolution of motor output shaft 13, while being held in rolling-contact with the outer race 47*b* of large-diameter ball bearing 47 and simultaneously radially guided by the associated roller retaining holes 41*a* of cage 41. By way of the repeated relocations of each of rollers 48 every revolutions of motor output shaft 13, rollers 48 move in the circumferential direction with respect to the waveform internal toothed portion 19*a* of annular member 19, while being held in rolling-contact with the outer race 47*b* of large-diameter ball bearing 47. In this manner, torque is transmitted through driven member 9 to camshaft 2, while the rotational speed of motor output shaft 13 is reduced. The reduction ratio of this type of speed reducer 8 can be determined by the number of rollers 48 (in other words, the number of roller retaining holes 41*a* of cage 41). The fewer the number of rollers 48 (roller retaining holes 41*a*), the lower the reduction ratio.

As discussed above, by controlling of the operation of phase converter 4 (constructed by electric motor 12 and speed reducer 8), that is, by execution of the normal-rotation/reverse-rotation control of motor output shaft 13, an angular phase of camshaft 2 relative to timing sprocket 1 can be changed, and as a result intake-valve open timing (IVO) and intake-valve closure timing (IVC) can be phase-advanced or phase-retarded. As clearly shown in FIG. 4, the clockwise rotary motion (normal-rotational motion) of camshaft 2 relative to timing sprocket 1 is restricted by abutment between the anticlockwise end face of radially-inward-protruding stopper portion if and the clockwise-opposing end face 2*c* of stopper recessed groove 2*b*. On the other hand, the anticlockwise rotary motion (reverse-rotational motion) of camshaft 2 relative to timing sprocket 1 is restricted by abutment between the clockwise end face of radially-inward-protruding stopper portion if and the anticlockwise-opposing end face 2*d* of stopper recessed groove 2*b*.

That is to say, when driven member 9 (camshaft 2) rotates in the same rotation direction as timing sprocket 1 during eccentric rotary motion of eccentric shaft portion 39, the maximum normal-rotational motion of driven member 9 (camshaft 2) is restricted by abutment between the anticlockwise end face of radially-inward-protruding stopper portion if and the clockwise-opposing end face 2*c* of stopper recessed groove 2*b*. Thus, the angular phase of camshaft 2 relative to timing sprocket 1 is changed to the maximum phase-advance state.

Conversely, when driven member 9 (camshaft 2) rotates in the reverse-rotational direction during eccentric rotary motion of eccentric shaft portion 39, the maximum reverse-rotational motion of driven member 9 (camshaft 2) is restricted by abutment between the clockwise end face of radially-inward-protruding stopper portion if and the anticlockwise-opposing end face 2*d* of stopper recessed groove 2*b*. Thus, the angular phase of camshaft 2 relative to timing sprocket 1 is changed to the maximum phase-retard state.

As a result, intake-valve open timing and intake-valve closure timing can be properly phase-changed, so as to improve the engine performance, such as fuel economy and engine power output, depending on the engine/vehicle operating condition.

According to the phase-control system of the shown embodiment, the engine stops under a state where the phase angle of camshaft 2 relative to timing sprocket 1 (the crankshaft) has been changed to a phase angle differing from the computed required phase angle suited for the next engine starting during an engine stopping period (that is, a phase angle deviated toward the phase-advance side or the phase-retard side with respect to the required phase angle) in advance of an operating mode shift to an engine stopped state. Immediately after the next engine starting (e.g., immediately after cranking starts), a state transition of the phase-change mechanism (phase converter 4 involving electric motor 12) from a static-friction state to a dynamic-friction state is created by a preliminary phase change of the phase angle of camshaft 2 relative to the crankshaft in the phase-retard direction by alternating torque (load torque) inputted to camshaft 2 and by de-energizing electric motor 12 for instance during cold-engine starting, or by a preliminary, gradual phase change of the phase angle of camshaft 2 relative to the crankshaft in the phase-advance direction by energizing and driving electric motor 12 against the load torque input of camshaft 2 for instance during warm-engine starting.

[Phase-Change Control Executed when Starting Engine from Cold (Low Temperatures)]

Figure 8:
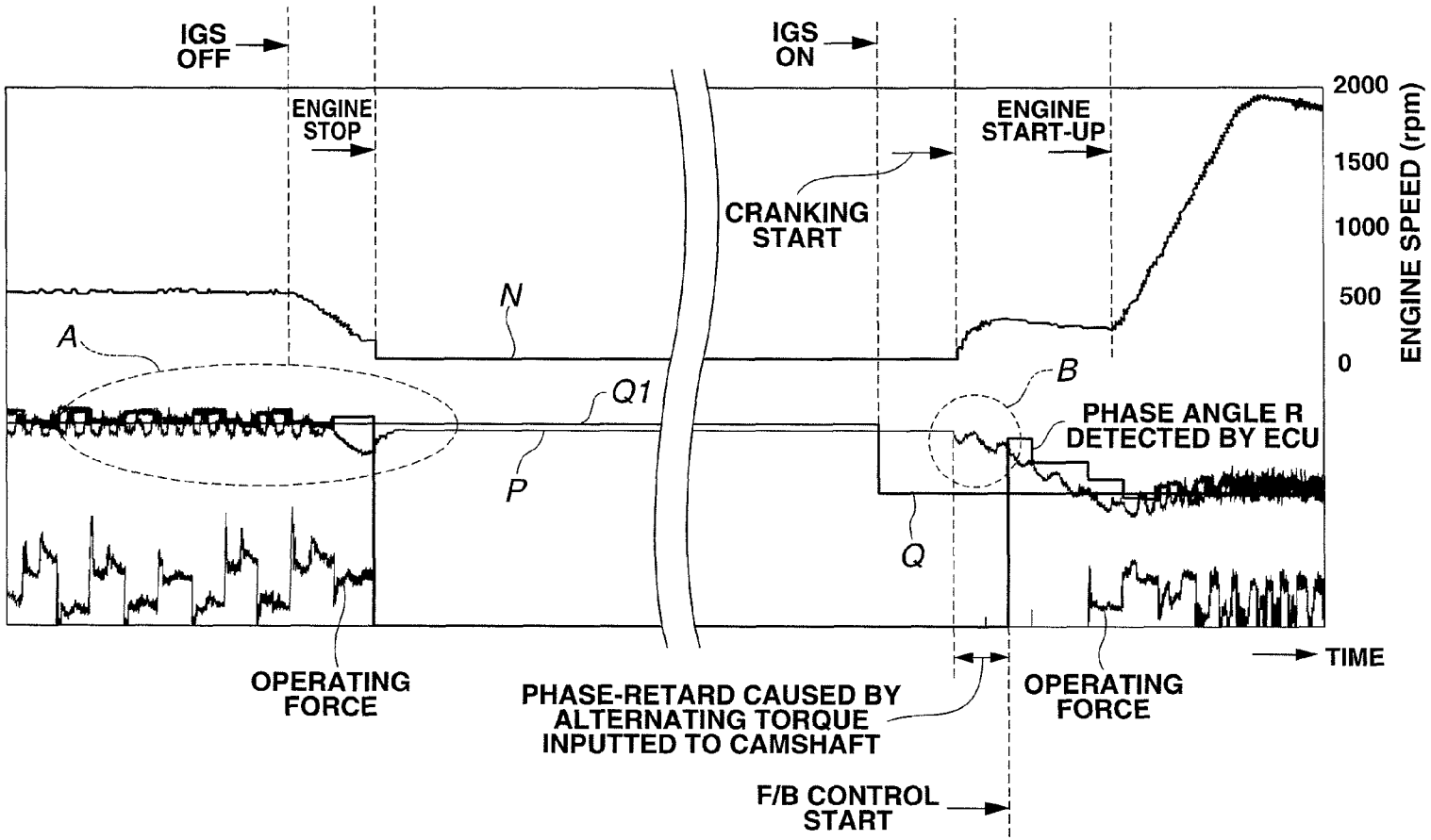
FIG. 8 is a time chart illustrating phase-change control executed by the VTC apparatus of the embodiment in particular during a time period from a point of time when the engine is stopped to a point of time when the engine is started from cold.
Figure 9:
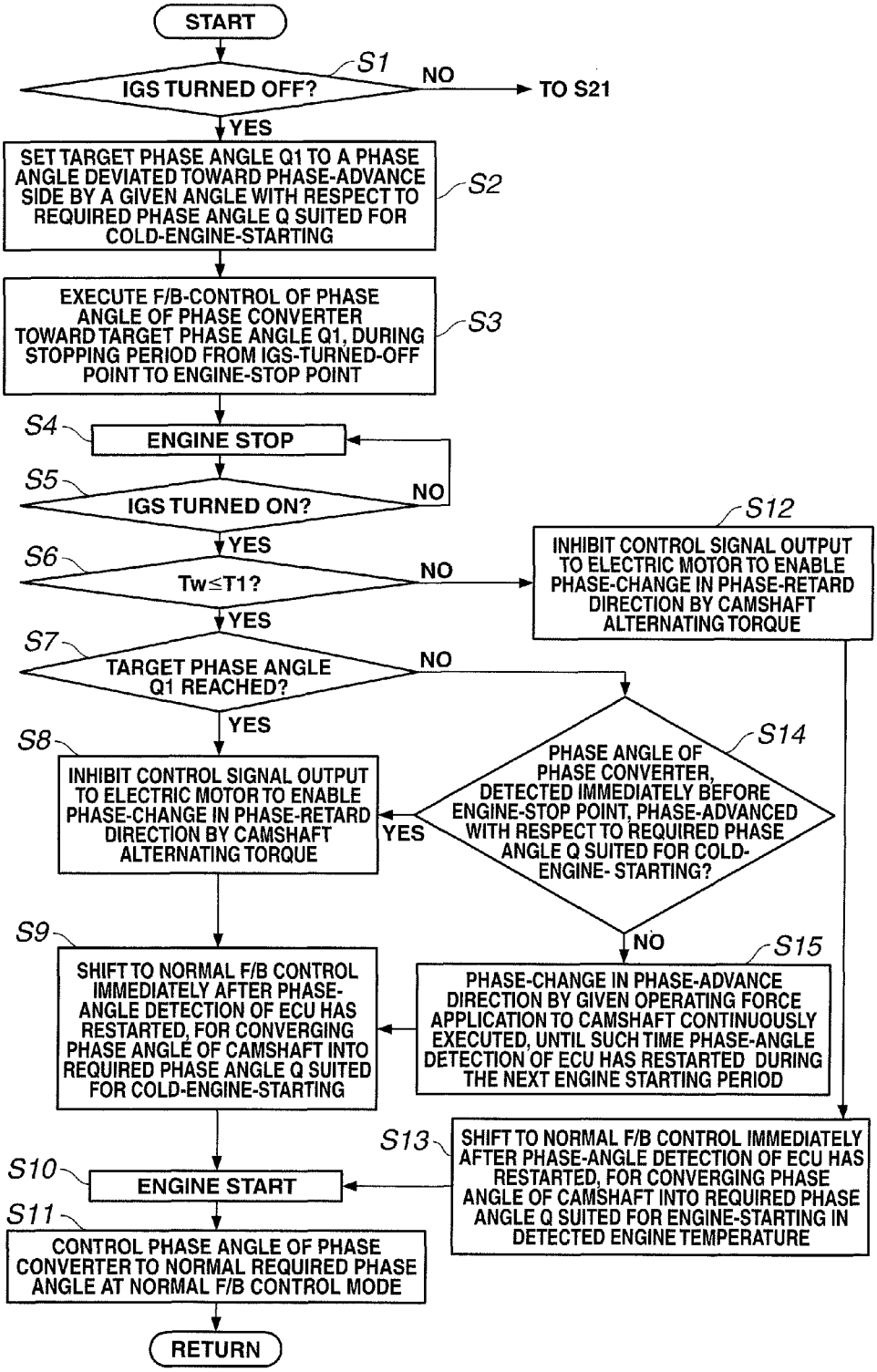
FIG. 9 is a flowchart illustrating a control routine executed within a controller of the VTC apparatus of the embodiment in particular during the time period from the engine-stop point to the cold-engine-start point.

First, phase-change control, executed by control unit 40 when starting/restarting the engine by turning the ignition switch (IGS) ON under a specified low-engine-temperature condition (a cold-engine state) where the engine temperature Tw is less than or equal to a predetermined temperature value T1, for instance when starting with a cold engine, is hereunder described in detail in reference to the time chart of FIG. 8 and the flowchart of FIG. 9.

As can be seen from the time chart of FIG. 8, immediately when the ignition switch IGS is turned OFF during an engine stopping period, the engine-crankshaft revolution speed, indicated by the line "N" in FIG. 8, tends to gradually decrease. At this time, control unit 40 sets a target phase angle (indicated by the line "Q1" in FIG. 8) of camshaft 2 relative to timing sprocket 1 (the crankshaft) to the phase-advance side in advance. Then, control unit 40 generates a control current (a control signal) corresponding to the target phase angle "Q1" to electric motor 12 of phase converter 4 for applying an operating force, produced by electric motor 12, to the camshaft 2, in such a manner as to bring the phase angle of camshaft 2 closer to the target phase angle, indicated by the line "Q1" in FIG. 8. As a result of this, phase-change control is executed such that the phase angle of camshaft 2 relative to timing sprocket 1 (i.e., the phase angle detected by control unit 40 and indicated by the line "R" in FIG. 8) shifts toward the target phase angle "Q1" (see the area "A" in FIG. 8). After this, rotation of the crankshaft stops and thus the engine operating mode becomes completely shifted to a stopped state.

When restarting the engine from cold by turning the ignition switch ON after a long elapsed time from the engine-stop point, on the one hand, control unit 40 sets the required phase angle (indicated by the line "Q" in FIG. 8) of camshaft 2 relative to the crankshaft to the phase-retard side suited for cold-engine-starting. However, on the other hand, the actual phase angle (indicated by the line "P" in FIG. 8) of camshaft 2 relative to the crankshaft remains kept at the phase-advance side without any phase-change to the required phase angle "Q" existing on the phase-retard side suited for cold-engine-starting, until such time that cranking has started.

Thereafter, immediately when cranking has started, by virtue of alternating torque, created owing to the valve-spring forces exerted on camshaft 2, the phase angle of camshaft 2 relative to the crankshaft can be automatically changed from the phase-advance side to the phase-retard side (see the control characteristic of the actual phase angle "P" within the area "B" in FIG. 8).

At this point of time, phase-angle detection, executed within control unit 40, restarts based on a detected pulse signal from the phase-angle detection means, and simultaneously feedback (F/B) control for the phase angle of camshaft 2 relative to the crankshaft restarts, in the form of rotation control of electric motor 12, based on the detected phase angle.

In this manner, a state transition from a static-friction state to a dynamic-friction state occurs by positive phase-change from the phase-advance side to the phase-retard side in advance of the start of F/B control for phase angle of camshaft 2 relative to the crankshaft. Hence, it is possible to remarkably enhance the responsiveness of phase-change control for phase angle of camshaft 2 relative to the crankshaft, by means of phase converter 4.

Details of the concrete phase-change control routine, executed within control unit 40 when starting the engine from cold, are hereunder described in reference to the flowchart of FIG. 9.

At step S1, a check is made to determine whether an ignition switch IGS is turned OFF by the driver. When the answer to step S1 is in the affirmative (YES), the routine proceeds to step S2. Conversely when the answer to step S1 is in the negative (NO), it is determined that the ignition switch IGS has already been turned ON and thus the engine is running. Hence, in the case that the answer to step S1 is negative, the routine proceeds to step S21 of the flowchart shown in FIG. 11.

At step S2, a target phase angle "Q1" is set to a phase angle deviated toward the phase-advance side by a given angle with respect to a required phase angle "Q" suited for cold-engine-starting (the next engine starting). Subsequently to step S2, step S3 occurs. By the way, in the shown embodiment, to enable appropriate setting of target phase angle "Q1" toward the phase-advance side with respect to the required phase angle "Q", the required phase angle "Q" is set to a phase angle between the maximum phase-advance position and the maximum phase-retard position.

At step S3, responsively to the target phase angle "Q1" set to the phase-advance side, a control current (a control signal) is outputted to electric motor 12 during a time period from the point of time at which the engine speed (the engine-crankshaft revolution speed) begins to decrease with the ignition switch IGS turned OFF to the point of time immediately before rotation of the crankshaft stops and thus the engine operating mode becomes completely shifted to a stopped state, so as to feedback-control, based on the target phase angle "Q1", the phase angle of camshaft 2 relative to the crankshaft (in other words, the phase angle of phase converter 4) toward the phase-advance side.

At step S4, rotation of the crankshaft stops and thus the engine operating mode becomes completely shifted to a stopped state.

At step S5, a check is made to determine whether the ignition switch IGS becomes turned ON by the driver for starting or restarting the engine. When the answer to step S5 is in the negative (NO), the routine returns from step S5 to step S4. Conversely when the answer to step S5 is in the affirmative (YES), the routine proceeds to step S6.

At step S6, a check is made to determine whether the engine temperature (e.g., the engine coolant temperature Tw), detected during the engine starting/restarting period, is less than or equal to a predetermined low temperature value T1. When the answer to step S6 is in the affirmative (Tw≤T1), the routine proceeds to step S7. Conversely when the answer to step S6 is in the negative (Tw>T1), the routine proceeds to step S12.

At step S7, a check is made to determine whether the latest up-to-date information about the actual phase angle of camshaft 2 relative to the crankshaft has already reached the target phase angle "Q1" by F/B control via electric motor 12 of phase converter 4, during the previously-noted time period from the ignition-switch turned-OFF point to the point of time immediately before the engine-stop point. When the answer to step S7 is in the affirmative (YES), the routine proceeds to step S8. Conversely when the answer to step S7 is in the negative (NO), the routine proceeds to step S14.

At step S8, a control signal output to electric motor 12 is inhibited to inhibit an operating force from being applied via phase converter 4 to camshaft 2 until such time that phase-angle detection of camshaft 2 relative to the crankshaft, executed within control unit 40, has initiated during the next engine starting period, thereby enabling the phase angle of camshaft 2 relative to the crankshaft to be automatically changed to the phase-retard side (in the phase-retard direction) by alternating torque, inputted to camshaft 2 owing to the valve-spring forces. Almost at this point of time of inhibition of operating force application to camshaft 2, cranking initiates. Subsequently to step S8, step S9 occurs.

At step S9, the phase-control mode is shifted to a normal F/B control mode (normally executed based on the required phase angle "Q" and the detected phase angle "R"), immediately after phase-angle detection executed within control unit 40 has restarted, for converging the phase angle of camshaft 2 into the required phase angle "Q", suited for cold-engine-starting (i.e., Tw≤T1). Thereafter, step S10 occurs.

At step S10, the engine starts.

At step S11, at the normal F/B control mode, the phase angle of camshaft 2 relative to the crankshaft (in other words, the phase angle of phase converter 4) is controlled to a normal required phase angle (suited for a normal engine operating condition).

Under a specific engine temperature condition defined by Tw>T1, the routine shifts from step S6 to step S12.

At step S12, a control signal output (a control current output) to electric motor 12 (in other words, energization of electric motor 12) is inhibited to inhibit an operating force from being applied via phase converter 4 to camshaft 2 until such time that phase-angle detection of camshaft 2 relative to the crankshaft, executed within control unit 40, has restarted during the next engine starting period, thereby enabling the phase angle of camshaft 2 relative to the crankshaft to be automatically changed to the phase-retard side (in the phase-retard direction) by alternating torque, exerted on camshaft 2 due to initiation of cranking. Thereafter, step S13 occurs.

At step S13, the phase-control mode is shifted to a normal F/B control mode (normally executed based on the required phase angle "Q" and the detected phase angle "R"), immediately after phase-angle detection executed within control unit 40 has restarted, for converging the phase angle of camshaft 2 into the required phase angle "Q", suited for engine-starting in the detected engine temperature Tw. Thereafter, the routine shifts from step S13 to step S10.

Under a specific condition where the target phase angle "Q1" has not yet been reached during the previously-noted time period from the ignition-switch turned-OFF point to the point of time immediately before the engine-stop point, the routine shifts from step S7 to step S14.

At step S14, a check is made to determine whether the phase angle of camshaft 2 (in other words, the phase angle of phase converter 4), detected immediately before the engine-stop point, exists on the phase-advance side with respect to the required phase angle "Q", suited for cold-engine-starting. When the answer to step S14 is in the affirmative (YES), the routine advances to step S8. Conversely when the answer to step S14 is in the negative (NO), the routine advances to step S15.

At step S15, responsively to a control signal output to electric motor 12, a given operating force is applied via phase converter 4 to camshaft 2 until such time that phase-angle detection of camshaft 2 relative to the crankshaft, executed within control unit 40, has restarted during the next engine starting period, thereby enabling the phase angle of camshaft 2 relative to the crankshaft to be changed to the phase-advance side (in the phase-advance direction) by the given operating force applied to camshaft 2. Thereafter, the routine shifts from step S15 to step S9.

In this manner, in a situation where the engine is started from cold (low temperatures), the phase angle (the actual phase angle "P") of camshaft 2 relative to the crankshaft is changed to the target phase angle "Q1" existing on the phase-advance side opposite to the required phase angle "Q" existing on the phase-retard side and suited for cold-engine-starting, in advance, by rotation control of electric motor 12 during the engine stopping period. After this, during the time period from (i) the time when cranking starts during the next engine starting period to (ii) the time when F/B control for the phase angle of camshaft 2 starts immediately after phase-angle detection executed within control unit 40 has restarted, a phase-change of the actual phase angle "P" of camshaft 2 (in other words, a phase-change of the phase angle of phase converter 4) from the target phase angle "Q1" of the phase-advance side to the required phase angle "Q" of the phase-retard side occurs in advance of the start of F/B control. By this, a state transition from a static-friction state to a dynamic-friction state occurs by the positive phase-change from the phase-advance side to the phase-retard side in advance of the start of F/B control.

Hence, it is possible to remarkably enhance the responsiveness of phase-change control for phase angle of camshaft 2 relative to the crankshaft, achieved by phase converter 4, from the point of time immediately after F/B control has initiated or restarted. By virtue of such a state transition to a dynamic-friction state, it is also possible to enhance the phase-change control stability.

Additionally, such a phase change of camshaft 2 to the phase-retard side can be achieved by alternating torque, inputted to camshaft 2 owing to the valve-spring forces during cranking, without using an operating force, produced by electric motor 2. This contributes to reduced electric power consumption. In more detail, when starting the engine from cold, the relative phase angle of camshaft 2 (during the engine stopping period) is controlled to a phase angle deviated toward the phase-advance side with respect to the required phase angle "Q". Hence, as soon as cranking initiates with the ignition switch turned ON, a self-return force toward the phase-retard side, caused by alternating torque (load torque) exerted on camshaft 2, acts on the phase converter 4. The self-return force serves as an assisting force that assists a phase-change action of phase converter 4 toward the required phase angle "Q". Thereafter, the F/B control, subsequently to such self-return of phase converter 4 toward the phase-retard side (the required phase angle "Q"), starts. Hence, it is possible to enhance the responsiveness of phase-change action of phase converter 4 during the subsequent feedback control. Utilizing such a self-return force facilitates the phase-change control.

Furthermore, the phase-control system is configured so that the engine can start/restart, while directing or changing the phase angle (the actual phase angle "P") of camshaft 2 relative to the crankshaft in the phase-retard direction from the target phase angle "Q1", set to the phase-advance side with respect to the required phase angle "Q", during the cold-engine starting period. This contributes to a good engine startability during the cold-engine starting period.

[Phase-Change Control Executed when Restarting Engine from Warmed-Up State (High Temperatures)]

Figure 10:
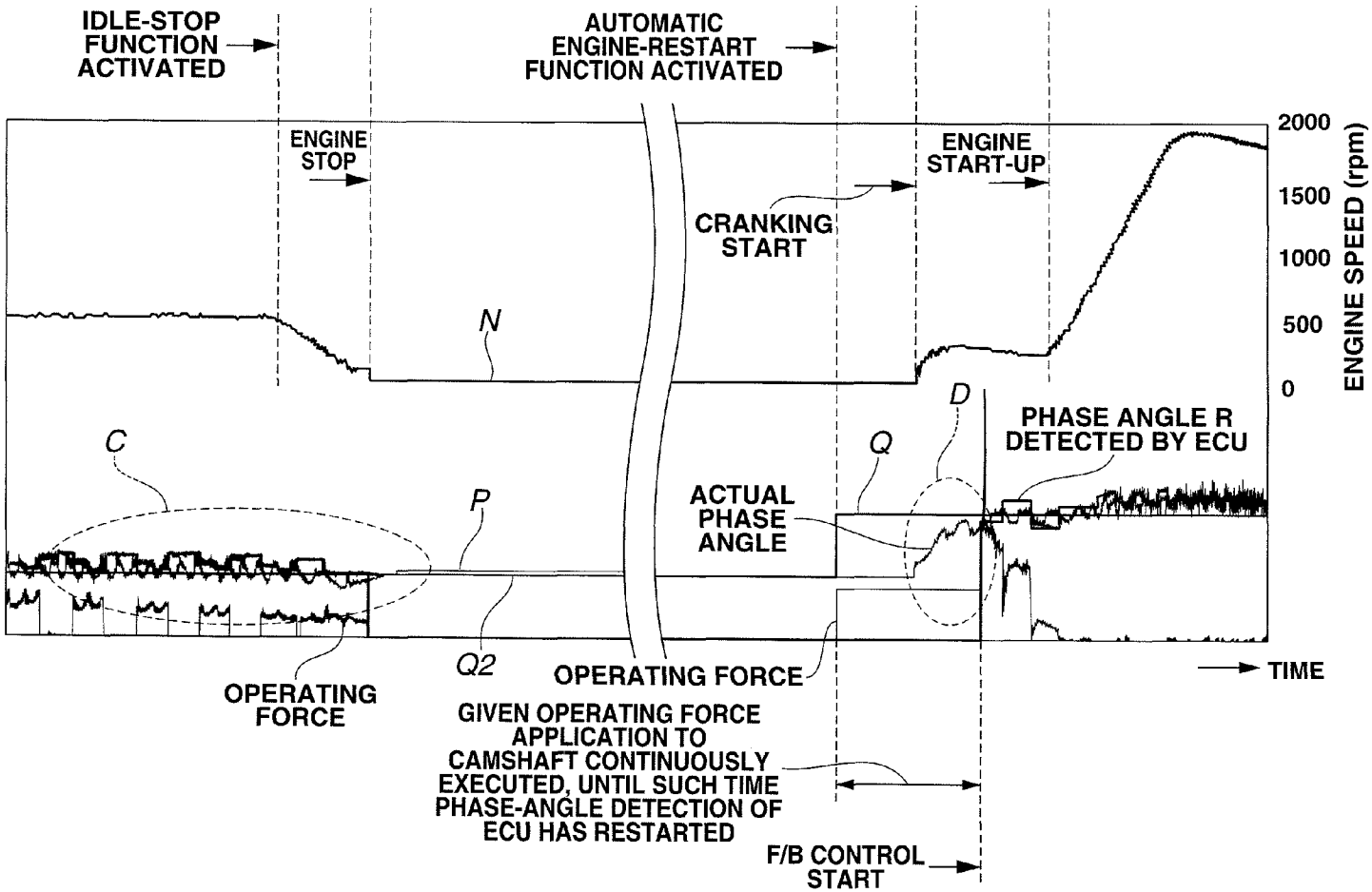
FIG. 10 is a time chart illustrating phase-change control executed by the VTC apparatus of the embodiment in particular during a time period from an automatic engine-stop point to an automatic engine-start point, after engine warm-up has been completed.
Figure 11:
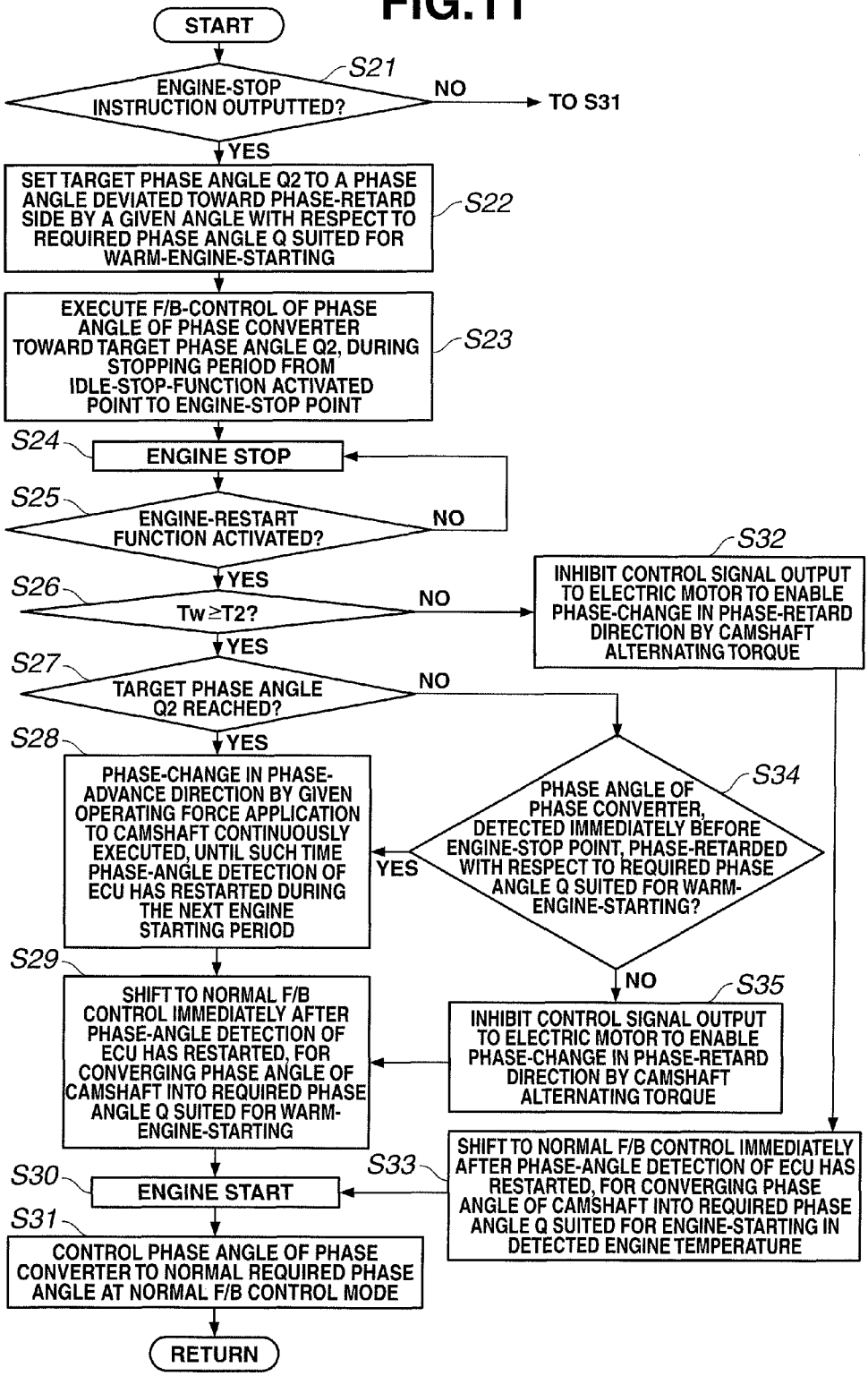
FIG. 11 is a flowchart illustrating a control routine executed within the controller of the VTC system of the embodiment in particular during the time period from the automatic engine-stop point to the automatic engine-start point, after engine warm-up has been completed.

Next, phase-change control, executed by control unit 40 when restarting the engine from a high-engine-temperature state (a warmed-up engine state) where the engine temperature Tw is greater than or equal to a predetermined temperature value T2, for instance, when automatically restarting the engine for a short time elapsed after the engine has been automatically stopped by a so-called idle-stop function (or an idling-stop function), is hereunder described in detail in reference to the time chart of FIG. 10 and the flowchart of FIG. 11.

As can be seen from the time chart of FIG. 10, immediately when the engine is automatically stopped by the idle-stop function during an automatic engine stopping period, the engine-crankshaft revolution speed, indicated by the line "N" in FIG. 10, tends to gradually decrease. At this time, control unit 40 sets a target phase angle (indicated by the line "Q2" in FIG. 10) of camshaft 2 relative to timing sprocket 1 (the crankshaft) to the phase-retard side in advance. Then, control unit 40 generates a control current (a control signal) corresponding to the target phase angle "Q2" to electric motor 12 of phase converter 4 for applying an operating force, produced by electric motor 12, to the camshaft 2, in such a manner as to bring the phase angle of camshaft 2 closer to the target phase angle, indicated by the line "Q2" in FIG. 10. As a result of this, phase-change control is executed such that the phase angle of camshaft 2 relative to timing sprocket 1 (i.e., the phase angle detected by control unit 40 and indicated by the line "R" in FIG. 10) shifts toward the target phase angle "Q2" (see the area "C" in FIG. 10). After this, rotation of the crankshaft stops and thus the engine operating mode becomes completely shifted to a stopped state.

When automatically restarting the engine from the warmed-up state (the high-engine-temperature state) after a short elapsed time from the engine-stop point, control unit 40 sets the required phase angle (indicated by the line "Q" in FIG. 10) of camshaft 2 relative to the crankshaft to the phase-advance side suited for warm-engine-starting in advance of initiation of cranking.

Thereafter, during a time period from the point of time at which cranking starts to the point of time at which phase-angle detection of camshaft 2 relative to the crankshaft, executed within control unit 40, restarts, responsively to a control signal output to electric motor 12, a given operating force, corresponding to the control signal, is forcibly applied via phase converter 4 to camshaft 2, thereby changing the phase angle of camshaft 2 relative to the crankshaft from the phase-retard side (i.e., the target phase angle "Q2") to the phase-advance side (i.e., the required phase angle "Q") by the applied operating force (see the control characteristic of the actual phase angle "P" within the area "D" in FIG. 10).

At this point of time, phase-angle detection, executed within control unit 40, restarts based on a detected pulse signal from the phase-angle detection means, and simultaneously feedback (F/B) control for the phase angle of camshaft 2 relative to the crankshaft restarts, in the form of rotation control of electric motor 12, based on the detected phase angle.

In this manner, a state transition from a static-friction state to a dynamic-friction state occurs by forcible phase-change from the phase-retard side to the phase-advance side in advance of the start of F/B control for phase angle of camshaft 2 relative to the crankshaft. Hence, it is possible to remarkably enhance the responsiveness of phase-change control for phase angle of camshaft 2 relative to the crankshaft, by means of phase converter 4.

Details of the concrete phase-change control routine, executed within control unit 40 when automatically restarting the engine from its warmed-up state, are hereunder described in reference to the flowchart of FIG. 11.

At step S21, a check is made to determine whether an engine-stop instruction (an engine-stop command signal) has been outputted from the control unit 40. In other words, a check is made to determine whether an idle-stop function has been activated. When the answer to step S21 is in the negative (NO), it is determined that the engine is running and then the routine proceeds to step S31. Conversely when the answer to step S21 is in the affirmative (YES), according to the engine-stop instruction the routine proceeds to step S22.

At step S22, a target phase angle "Q2" is set to a phase angle deviated toward the phase-retard side by a given angle with respect to a required phase angle "Q" suited for warm-engine-starting (the next engine starting). Subsequently to step S22, step S33 occurs. By the way, in the shown embodiment, to enable appropriate setting of target phase angle "Q2" toward the phase-retard side with respect to the required phase angle "Q", the required phase angle "Q" is set to a phase angle between the maximum phase-advance position and the maximum phase-retard position.

At step S23, responsively to the target phase angle "Q2" set to the phase-retard side, a control current (a control signal) is outputted to electric motor 12 during a time period from the point of time at which the engine speed (the engine-crankshaft revolution speed) begins to decrease by activation of the idle-stop function to the point of time immediately before rotation of the crankshaft stops and thus the engine operating mode becomes completely shifted to a stopped state, so as to feedback-control, based on the target phase angle "Q2", the phase angle of camshaft 2 relative to the crankshaft (in other words, the phase angle of phase converter 4) toward the phase-retard side.

At step S24, rotation of the crankshaft stops and thus the engine operating mode becomes completely shifted to a stopped state.

At step S25, a check is made to determine whether the electric power source becomes turned ON by releasing the brake pedal for activation of an automatic engine-restart function. When the answer to step S25 is in the negative (NO), the routine returns from step S25 to step S24. Conversely when the answer to step S25 is in the affirmative (YES), the routine proceeds to step S26.

At step S26, a check is made to determine whether the engine temperature (e.g., the engine coolant temperature Tw), detected during the engine restarting period, is greater than or equal to a predetermined temperature value T2. When the answer to step S26 is in the affirmative (Tw≥T2), the routine proceeds to step S27. Conversely when the answer to step S26 is in the negative (Tw<T2), the routine proceeds to step S32.

At step S27, a check is made to determine whether the latest up-to-date information about the actual phase angle of camshaft 2 relative to the crankshaft has already reached the target phase angle "Q2" by F/B control via electric motor 12 of phase converter 4, during the previously-noted time period from the idle-stop-function activated point to the point of time immediately before the engine-stop point. When the answer to step S27 is in the affirmative (YES), the routine proceeds to step S28. Conversely when the answer to step S27 is in the negative (NO), the routine proceeds to step S34.

At step S28, responsively to a control signal output to electric motor 12, a given operating force is applied via phase converter 4 to camshaft 2 until such time that phase-angle detection of camshaft 2 relative to the crankshaft, executed within control unit 40, has restarted during the next engine starting period, thereby enabling the phase angle of camshaft 2 relative to the crankshaft to be changed to the required phase angle "Q" suited for warm-engine-starting, that is, in the phase-advance direction, by the given operating force applied to camshaft 2. Subsequently to step S28, step S29 occurs.

At step S29, the phase-control mode is shifted to a normal F/B control mode (normally executed based on the required phase angle "Q" and the detected phase angle "R"), immediately after phase-angle detection executed within control unit 40 has restarted, for converging the phase angle of camshaft 2 into the required phase angle "Q", suited for warm-engine-starting (i.e., Tw≥T2). Thereafter, step S30 occurs.

At step S30, the engine starts.

At step S31, at the normal F/B control mode, the phase angle of camshaft 2 relative to the crankshaft (in other words, the phase angle of phase converter 4) is controlled to a normal required phase angle (suited for a normal engine operating condition) via the phase converter 4.

Under a specific engine temperature condition defined by Tw<T2, the routine shifts from step S26 to step S32.

At step S32, a control signal output to electric motor 12 is inhibited to inhibit an operating force from being applied via phase converter 4 to camshaft 2 until such time that phase-angle detection of camshaft 2 relative to the crankshaft, executed within control unit 40, has restarted during the next engine starting period, thereby enabling the phase angle of camshaft 2 relative to the crankshaft to be automatically changed to the phase-retard side (in the phase-retard direction) by alternating torque, exerted on camshaft 2 due to initiation of cranking. Thereafter, step S33 occurs.

At step S33, the phase-control mode is shifted to a normal F/B control mode (normally executed based on the required phase angle "Q" and the detected phase angle "R"), immediately after phase-angle detection executed within control unit 40 has restarted, for converging the phase angle of camshaft 2 into the required phase angle "Q", suited for engine-starting in the detected engine temperature Tw. Thereafter, the routine shifts from step S33 to step S30.

Under a specific condition where the target phase angle "Q2" has not yet been reached during the previously-noted time period from the idle-stop-function activated point to the point of time immediately before the engine-stop point, the routine shifts from step S27 to step S34.

At step S34, a check is made to determine whether the phase angle of camshaft 2 (in other words, the phase angle of phase converter 4), detected immediately before the engine-stop point, exists on the phase-retard side with respect to the required phase angle "Q", suited for warm-engine-starting. When the answer to step S34 is in the affirmative (YES), the routine advances to step S28. Conversely when the answer to step S34 is in the negative (NO), the routine advances to step S35.

At step S35, a control signal output to electric motor 12 is inhibited to inhibit an operating force from being applied via phase converter 4 to camshaft 2 until such time that phase-angle detection of camshaft 2 relative to the crankshaft, executed within control unit 40, has restarted during the next engine starting period, thereby enabling the phase angle of camshaft 2 relative to the crankshaft to be automatically changed to the phase-retard side (in the phase-retard direction) by alternating torque, exerted on camshaft 2 due to initiation of cranking. Thereafter, the routine shifts from step S35 to step S29.

In this manner, when the engine is restarted from warm or hot (high temperatures), for instance in automotive vehicles having an idle-stop function, the phase angle (the actual phase angle "P") of camshaft 2 relative to the crankshaft is changed to the target phase angle "Q2" existing on the phase-retard side opposite to the required phase angle "Q" existing on the phase-advance side and suited for warm-engine-starting, in advance, by rotation control of electric motor 12 during the engine stopping period. After this, during the time period from (i) the time when cranking starts during the next engine starting period to (ii) the time when F/B control for the phase angle of camshaft 2 starts immediately after phase-angle detection executed within control unit 40 has restarted, a phase-change of the actual phase angle "P" of camshaft 2 (in other words, a phase-change of the phase angle of phase converter 4) from the target phase angle "Q2" of the phase-retard side to the required phase angle "Q" of the phase-advance side occurs in advance of the start of F/B control. By this, a state transition from a static-friction state to a dynamic-friction state occurs by the positive phase-change from the phase-retard side to the phase-advance side in advance of the start of F/B control.

Hence, it is possible to remarkably enhance the responsiveness of phase-change control for phase angle of camshaft 2 relative to the crankshaft, achieved by phase converter 4, from the point of time immediately after F/B control has initiated or restarted. By virtue of such a state transition to a dynamic-friction state, it is also possible to enhance the phase-change control stability. Furthermore, the phase-control system is configured so that the engine can restart, while directing or changing the phase angle (the actual phase angle "P") of camshaft 2 relative to the crankshaft in the phase-advance direction from the target phase angle "Q2", set to the phase-retard side with respect to the required phase angle "Q", during the warm-engine starting period. This contributes to a good engine startability during the warm-engine starting period.

Also, to ensure a better warm-engine startability, in the shown embodiment, regarding an engine startable phase-angle range, within which the engine can start under a state where engine temperature (e.g., engine coolant temperature Tw) is greater than or equal to the predetermined temperature value T2, a phase-retard side startable phase-angle range with respect to the required phase angle "Q" is set to be wider than a phase-advance side startable phase-angle range with respect to the required phase angle "Q".

Additionally, in the shown embodiment, an amount of electric current, which current is supplied to electric motor 12 driven in the direction that the phase angle of camshaft 2 is brought closer to the required phase angle "Q" during the time period from the point of time when cranking starts to the point of time when detection of the rotational position of camshaft 2, executed within the phase angle detector of the controller, initiates, is controlled to increase, as engine temperature (e.g., engine coolant temperature Tw) decreases. This ensures the enhanced responsiveness of phase-change action of phase converter 4 during the engine starting period, regardless of a change in engine temperature.

Moreover, in the shown embodiment, the phase angle of camshaft 2 to be held during the stopping period of the engine is altered depending on the detected engine temperature (engine coolant temperature Tw).

The above-mentioned phase-change control, executed when restarting the engine from its warmed-up state, is exemplified in automotive vehicles having an idle-stop function and an automatic engine-restart function. It will be appreciated that this phase-change control is not limited to the application to such an idling-stop-system equipped vehicle. The phase-change control mode for engine-restarting from the warmed-up state may be applied to any situation where an engine is restarted after a short elapsed time from an ignition-switch turned-off point even in a non-idling-stop-system equipped vehicle.

Control unit 40 is also configured to execute phase-control from the phase-advance side or the phase-retard side to the required phase angle "Q" via phase converter (4) (via electric motor 12) without any overshoot, in advance of an operating mode shift to an engine stopped state. In contrast, suppose that undesirable hunting (overshoot and undershoot) takes place during phase-control to the required phase angle "Q". This leads to a long settling time, that is, lowered phase-change control responsiveness. To avoid this, in the shown embodiment, control unit 40 is configured to phase-change the actual phase angle "P" of camshaft 2 relative to the crankshaft to the required phase angle "Q" without any overshoot, in advance of the start of normal F/B control, normally executed based on the required phase angle "Q" and the detected phase angle "R". That is, the feedback-control (F/B) system is configured such that phase converter 4 is operated by feedback-control without any overshoot that the system output response proceeds beyond the required phase angle "Q".

Moreover, in the shown embodiment, regarding the phase difference (|Q1−Q1|; |Q2−Q|) between (i) the target phase angle "Q1" (set immediately after an engine-stop point in a cold-engine state) or "Q2" (set immediately after an engine-stop point in a warm-engine state) and (ii) the required phase angle "Q", the lower the engine temperature, the less phase difference is set. That is, the phase difference (|Q1−Q|; |Q2−Q|) can be reduced in accordance with a decrease in engine temperature, thus ensuring shortened arrival time to the required phase angle "Q" during the engine staring period.

Furthermore, in the shown embodiment, the phase-change control system (control unit 40) is configured to perform normal-rotation/reveres-rotation control of motor output shaft 13 such that electric motor 12 of phase converter 4 is driven (rotated) in the same direction of rotation immediately before and immediately after initiation (start) of normal F/B control, by which the phase angle of camshaft 2 can be brought closer to the required phase angle "Q" by feeding back the result of detection of the phase angle detector (i.e., the detected phase angle "R"). In other words, the phase-change control system (control unit 40) is configured to start normal F/B control, by which the phase angle of camshaft 2 can be brought closer to the required phase angle "Q" by feeding back the result of detection of the phase angle detector, in a manner so as to drive the electric motor in the same rotational direction continuously from a state where electric motor 12 has already rotated in advance during the engine starting period. Thus, it is possible to effectively suppress an undesirable time loss occurring when electric motor 12 is rotated reversely, and/or an undesirable overshoot of phase-change control occurring when a revolution speed of electric motor 12 becomes excessive.

Additionally, in the shown embodiment, as shown in FIG. 1, annular slip rings 26*a*-26*b* are fixed to the front end face of synthetic-resin plate 22, and thus the second brushes 30*a*-30*b* can be axially abutted-engagement with the respective slip rings 26*a*-26*b* by virtue of the brush retaining portion 28*a* (brush retainer 28), thereby ensuring easy and reliable abutted-engagement (electric-contact) between the second brushes and the respective slip rings. That is to say, first, component parts, including at least the second brushes 30*a*-30*b* and coil springs 32*a*-32*b*, are pre-inserted into the brush retaining portion 28*a* of brush retainer 28. Thereafter, the brush retaining portion 28*a* of brush retainer 28 with the second brushes 30*a*-30*b* and coil springs 32*a*-32*b* is axially inserted and fitted into the brush-retainer bore 3*c*, formed as a guide surface for the brush retainer 28, such that the outside end faces of the second brushes 30*a*-30*b* abut with the respective slip rings 26*a*-26*b* with compressional deformations of coil springs 32*a*-32*b*. As best seen in FIG. 7, the bolt insertion holes 28*e*, 28*e* of bracket portions 28*c*, 28*c* are aligned with the respective female-screw-threaded portions formed in the cover main portion 3*a* of cover member 3. Under these conditions, bolts 36, 36 are inserted through the respective bolt insertion holes 28*e*, 28*e* and further screwed into the respective female-screw-threaded portions formed in the cover main portion 3*a*, such that brush retainer 28 is certainly secured to the cover main portion 3*a* of cover member 3 by fastening the bracket portions 28*c*, 28*c* with bolts 36, 36.

Also, by fastening the bracket portions 28*c*, 28*c* with bolts 36, 36, seal member 34 is elastically deformed and brought into elastic-contact with the annular front end face of cylindrical wall portion 3*b*, thereby providing a good seal between the outer peripheral surface of brush retaining portion 28*a* and the annular front end face of cylindrical wall portion 3*b*.

As discussed above, by axial installation of the brush retaining portion 28*a* of brush retainer 28 with the second brushes 30*a*-30*b* and coil springs 32*a*-32*b* into the brush-retainer bore 3*c* of cover member 3, the second brushes 30*a*-30*b* can be brought into abutted-engagement (elastic-contact) with the respective slip rings 26*a*-26*b* in place, without providing any stopper for positioning. This contributes to easy assembling work, lower system installation time and costs, and reduced service time.

Additionally, at the initial stage of axial installation (insertion) of the brush retaining portion 28*a* with the second brushes 30*a*-30*b* and coil springs 32*a*-32*b* into the brush-retainer bore 3*c*, the second brushes 30*a*-30*b* become still kept out of contact with the respective slip rings 26*a*-26*b*, but at the last stage of the axial installation the second brushes 30*a*-30*b* can be reliably brought into elastic-contact (sliding electrical contact) with the respective slip rings 26*a*-26*b* owing to the previously-described dimensional relationship between the length L and the length L1, that is, L<L1. This ensures the stable operating ability (the stable, good electric-current supply) of the brush-retaining structure.

The entire contents of Japanese Patent Application No. 2011-003793 (filed Jan. 12, 2011) are incorporated herein by reference.

While the foregoing is a description of the preferred embodiments carried out the invention, it will be understood that the invention is not limited to the particular embodiments shown and described herein, but that various changes and modifications may be made without departing from the scope or spirit of this invention as defined by the following claims.

What is claimed is:

1. A controller of a valve timing control apparatus including a drive rotary member adapted to rotate in synchronism with rotation of a crankshaft of an engine, an electric motor which rotates together with the drive rotary member and to which electric current is supplied via brushes, and a phase converter configured to change a phase angle of a camshaft relative to the crankshaft by relatively rotating an output shaft of the electric motor with respect to the drive rotary member, said controller comprising:

a detection section configured to detect a rotational position of the camshaft; and a control section programmed to perform the following, (a) executing phase-control via the phase converter for bringing the phase angle of the camshaft relative to the crankshaft closer to a required phase angle suited for engine-starting during a starting period of the engine;

(b) controlling the phase angle of the camshaft during a stopping period of the engine to a target phase angle differing from the required phase angle suited for engine-starting;

(c) changing the phase angle of the camshaft from the target phase angle toward the required phase angle during a time period from a point of time when cranking starts during a restarting period of the engine to a point of time when detection of the rotational position of the camshaft, executed within the detection section, initiates during the engine restarting period; and (d) starting feedback-control for the phase angle of the camshaft via the phase converter from the point of time of initiation of detection of the rotational position of the camshaft, executed within the detection section, for bringing the phase angle of the camshaft closer to the required phase angle.

2. The controller of the valve timing control apparatus as claimed in claim 1, wherein:

the phase converter comprises:

the electric motor; and a speed reducer provided for reducing a rotational speed of the output shaft of the electric motor and for transmitting the reduced rotational speed to the camshaft.

3. The controller of the valve timing control apparatus as claimed in claim 2, wherein:

the detection section is configured to calculate, based on information from a sensor that detects a rotational position of the output shaft of the electric motor, the phase angle of the camshaft relative to the crankshaft.

4. The controller of the valve timing control apparatus as claimed in claim 1, wherein:

the required phase angle is set to a phase angle between a maximum phase-advance position and a maximum phase-retard position.

5. The controller of the valve timing control apparatus as claimed in claim 4, wherein:

the phase converter is operated by the feedback-control without any overshoot that a feedback-control system output response proceeds beyond the required phase angle.

6. The controller of the valve timing control apparatus as claimed in claim 4, wherein:

the phase angle of the camshaft during the stopping period of the engine is controlled to a phase angle deviated toward a phase-advance side with respect to the required phase angle; and the phase converter is further configured to enable the camshaft to be relatively rotated with respect to the drive rotary member by a load torque exerted on the camshaft.

7. The controller of the valve timing control apparatus as claimed in claim 6, wherein:

the phase converter is shifted by the load torque of the camshaft without energizing the electric motor, in a direction that the phase angle of the camshaft is brought closer to the required phase angle, during the time period from the point of time when cranking starts to the point of time when detection of the rotational position of the camshaft, executed within the detection section, initiates.

8. The controller of the valve timing control apparatus as claimed in claim 6, wherein:

the electric motor is energized during the time period from the point of time when cranking starts to the point of time when detection of the rotational position of the camshaft, executed within the detection section, initiates.

9. The controller of the valve timing control apparatus as claimed in claim 4, wherein:

the phase angle of the camshaft during the stopping period of the engine is controlled to a phase angle deviated toward a phase-retard side with respect to the required phase angle; and regarding an engine startable phase-angle range, within which the engine can start under a state where a temperature of the engine is greater than or equal to a predetermined temperature value, a phase-retard side startable phase-angle range with respect to the required phase angle is set to be wider than a phase-advance side startable phase-angle range with respect to the required phase angle.

10. The controller of the valve timing control apparatus as claimed in claim 4, wherein:

the phase angle of the camshaft during the stopping period of the engine is controlled to a phase angle deviated toward a phase-retard side with respect to the required phase angle; and the phase converter is further configured to enable the camshaft to be relatively rotated with respect to the drive rotary member by a given operating force applied to the camshaft by driving the electric motor.

11. The controller of the valve timing control apparatus as claimed in claim 1, wherein:

the electric motor is driven in a direction that the phase angle of the camshaft is brought closer to the required phase angle, during the time period from the point of time when cranking starts to the point of time when detection of the rotational position of the camshaft, executed within the detection section, initiates.

12. The controller of the valve timing control apparatus as claimed in claim 11, wherein:

an amount of electric current, which current is supplied to the electric motor driven in the direction that the phase angle of the camshaft is brought closer to the required phase angle during the time period from the point of time when cranking starts to the point of time when detection of the rotational position of the camshaft, executed within the detection section, initiates, is controlled to increase, as a temperature of the engine decreases.

13. The controller of the valve timing control apparatus as claimed in claim 1, wherein:

the phase angle of the camshaft to be held during the stopping period of the engine is altered depending on a temperature of the engine.

14. The controller of the valve timing control apparatus as claimed in claim 13, wherein:

a phase difference between the phase angle of the camshaft during the stopping period of the engine and the required phase angle is controlled to decrease, as a temperature of the engine decreases.

15. A controller of a valve timing control apparatus including a drive rotary member adapted to rotate in synchronism with rotation of a crankshaft of an engine, an electric motor which rotates together with the drive rotary member and to which electric current is supplied via brushes, and a phase converter configured to change a phase angle of a camshaft relative to the crankshaft by relatively rotating an output shaft of the electric motor with respect to the drive rotary member, said controller comprising:

a detection section configured to detect a rotational position of the camshaft; and a control section programmed to perform the following, starting phase-control, by which the phase angle of the camshaft can be brought closer to a required phase angle suited for engine-starting via the phase converter by feeding back a result of detection of the detection section, continuously from a state where the electric motor has already rotated during a starting period of the engine.

16. The controller of the valve timing control apparatus as claimed in claim 15, wherein:

the electric motor is driven in the same direction of rotation immediately before and immediately after starting the phase-control, by which the phase angle of the camshaft can be brought closer to the required phase angle by feeding back the result of detection of the detection section.

17. A valve timing control apparatus of an internal combustion engine comprising:

a drive rotary member adapted to rotate in synchronism with rotation of a crankshaft of the engine;

an electric motor which rotates together with the drive rotary member and to which electric current is supplied via brushes;

a phase converter configured to change a phase angle of a camshaft relative to the crankshaft by relatively rotating an output shaft of the electric motor with respect to the drive rotary member;

a phase angle detector configured to detect a rotational position of the camshaft; and a controller comprising a processor programmed to perform the following, (a) executing phase-control via the phase converter for bringing the phase angle of the camshaft relative to the crankshaft closer to a required phase angle suited for engine-starting during a starting period of the engine;

(b) stopping the phase converter at a target phase angle differing from the required phase angle during a stopping period of the engine; and (c) starting feedback-control, by which the phase angle of the camshaft can be brought closer to the required phase angle by feeding back a result of detection of the phase angle detector, in a manner so as to drive the electric motor in the same direction of rotation of the electric motor continuously from a state where the electric motor has already rotated after initiation of cranking during a restarting period of the engine.

* * * * *